US009196992B2

(12) United States Patent
Kojima et al.

(10) Patent No.: US 9,196,992 B2
(45) Date of Patent: Nov. 24, 2015

(54) FRAME-SHAPED CONNECTOR HAVING REDUCED CONTACT MEMBER PITCH

(71) Applicant: JAPAN AVIATION ELECTRONICS INDUSTRY, LIMITED, Shibuya-ku, Tokyo (JP)

(72) Inventors: Takeru Kojima, Tokyo (JP); Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 222 days.

(21) Appl. No.: 13/891,951

(22) Filed: May 10, 2013

(65) Prior Publication Data

US 2013/0330971 A1 Dec. 12, 2013

(30) Foreign Application Priority Data

Jun. 11, 2012 (JP) ..... 2012-132023

(51) Int. Cl.
*H01R 12/00* (2006.01)
*H01R 13/405* (2006.01)
*H01R 12/71* (2011.01)

(52) U.S. Cl.
CPC ..... *H01R 13/405* (2013.01); *H01R 12/714* (2013.01)

(58) Field of Classification Search
CPC .. H01R 23/722; H01R 13/2414; H05K 3/365; H05K 7/1069
USPC ..... 439/66, 67, 71, 86, 91
See application file for complete search history.

(56) References Cited

U.S. PATENT DOCUMENTS

| | | | | |
|---|---|---|---|---|
| 7,303,403 | B2 * | 12/2007 | Kuwahara | 439/66 |
| 7,329,130 | B2 * | 2/2008 | Saito et al. | 439/66 |
| 7,351,069 | B2 * | 4/2008 | Matsuo et al. | 439/66 |
| 7,537,462 | B2 * | 5/2009 | Higuchi et al. | 439/71 |
| 7,794,234 | B2 * | 9/2010 | Kitajima et al. | 439/66 |
| 7,862,349 | B1 | 1/2011 | Takahashi et al. | |
| 8,113,852 | B2 * | 2/2012 | Tamura | 439/66 |
| 8,870,580 | B2 * | 10/2014 | Kojima et al. | 439/66 |
| 8,920,179 | B2 * | 12/2014 | Kuwahara et al. | 439/66 |
| 8,936,473 | B2 * | 1/2015 | Takahashi et al. | 439/71 |

FOREIGN PATENT DOCUMENTS

JP 2011-049142 A 3/2011

* cited by examiner

*Primary Examiner* — Thanh Tam Le
(74) *Attorney, Agent, or Firm* — Holtz, Holtz, Goodman & Chick PC

(57) ABSTRACT

A connector capable of realizing a narrower pitch of contact members, and suppressing displacement of the contact members. A connector comprises a frame and a plurality of contact members held by the frame. The contact members held by the frame are elastically deformed by being sandwiched between an IC package and a printed board. At this time, terminal portions of the IC package and terminal portions of the printed board are electrically connected via a plurality of conductive path portions of each contact member. The frame is formed by a frame portion, a plurality of longitudinal ribs extending in a manner bridging the frame portion, and a plurality of transverse ribs extending orthogonal to the longitudinal ribs in a manner bridging the frame portion. The contact members are held in slits formed by the longitudinal ribs and the transverse ribs.

10 Claims, 45 Drawing Sheets

FRAME-SHAPED CONNECTOR HAVING REDUCED CONTACT MEMBER PITCH

BACKGROUND OF THE INVENTION

1. Field of the Invention

This invention relates to a connector.

2. Description of the Related Art

Conventionally, as shown in FIGS. 40 to 43, there has been proposed a connector including a plurality of conductive elastic bodies 700, an inner frame 800 which holds the plurality of conductive elastic bodies 700, and an outer frame 900 which holds the inner frame 800 in a movable manner (see Japanese Laid-Open Patent Publication (Kokai) No. 2011-49142, (Paragraphs 0030, 0031, 0035, 0036, and 0039, FIGS. 1, 2, 5, and 7)). Note that FIGS. 40, 41, 42, and 43 correspond to FIGS. 1, 2, 5, and 7 in Japanese Laid-Open Patent Publication (Kokai) No. 2011-49142, respectively. However, reference numerals in the drawings are changed, and some of them are deleted.

As shown in FIG. 41, each conductive elastic body 700 includes an insulating elastic body 710, an insulating film 720 affixed to the elastic body 710, a plurality of conductors 730 formed on the insulating film 720, and a reinforcing member 740 embedded in the elastic body 710. Each conductor 730 includes a connection portion 734 extending in a direction Z, and two contact portions 732 located at opposite ends of the connection portion 734.

The inner frame 800 is made of resin. The inner frame 800 is formed into a substantially plate-like shape. As shown in FIG. 42, the inner frame 800 is formed with a plurality of slits 830.

As shown in FIG. 42, the inner frame 800 includes a main part 810 having a substantially rectangular frame shape. In an area surrounded by the main part 810, there are arranged a plurality of partition walls 832 each extending in a direction X and a plurality of partition walls 833 each extending in a direction Y orthogonal to the direction X. The main part 810, the plurality of partition walls 832, and the plurality of partition walls 833 are integrally molded of resin. The plurality of partition walls 832 are arranged at equally-spaced intervals in the direction Y, and the plurality of partition walls 833 are arranged at equally-spaced intervals in the direction X. Spaces formed by the partition walls 832 and 833 are the slits 830. The conductive elastic bodies 700 are inserted in the slits 830 and are supported by the partition walls 832.

The outer frame 900 is made of resin. As shown in FIG. 40, the outer frame 900 is formed into a substantially rectangular frame-like shape. The outer frame 900 and the inner frame 800 are assembled as shown in FIG. 43.

When using the connector described above, the connector is sandwiched between two objects to be connected (not shown), whereby the elastic body 710 of each conductive elastic body 700 is elastically deformed, and respective one contact portions 732 of the conductors 730 of each conductive elastic body 700 are brought into contact with terminal portions (not shown) formed on one of the objects to be connected, and the respective other contact portions 732 of the conductors 730 of the conductive elastic body 700 are brought into contact with terminal portions (not shown) formed on the other of the objects to be connected. As a result, the two objects to be connected are electrically connected.

To realize a narrower pitch of the conductive elastic bodies 700 of the above-described connector, it is only necessary to reduce the thickness of each of the partition walls 832 and 833.

However, the main part 810, the plurality of the partition walls 832, and the plurality of the partition walls 833 are integrally molded of resin, and hence if the partition walls 832 and 833 are reduced in thickness, this makes it difficult to perform resin molding, and even if the main part 810 and the partition walls 832 and 833 can be molded of resin with high accuracy, the strength of each of the partition walls 832 and 833 is reduced. As a consequence, when the conductive elastic bodies 700 are deformed during use of the connector, an amount of deformation of each of the partition walls 832 and 833 is increased, so that the contact portions 732 of the conductors 730 of each conductive elastic body 700 are displaced with respect to respective associated ones of the terminal portions of each of the objects to be connected, which lowers the contact reliability.

SUMMARY OF THE INVENTION

The present invention has been made in view of these circumstances, and an object thereof is to provide a connector that is capable of realizing a narrower pitch of contact members, and suppressing displacement of the contact members.

To attain the above object, the present invention provides a connector that electrically connects between a first object to be connected and a second object to be connected, comprising a frame that includes a frame portion, a plurality of longitudinal members each extending in a manner bridging the frame portion, and a plurality of transverse members each extending orthogonal to the plurality of longitudinal members in a manner bridging the frame portion, at least the transverse members, out of the longitudinal members and the transverse members, having insulation properties, and a plurality of contact members that are elastically deformed by being sandwiched between the first object to be connected and the second object to be connected, each contact member including a plurality of conductive path portions for electrically connecting first terminal portions formed on the first object to be connected and second terminal portions formed on the second object to be connected, respectively, and being held in slits formed by the longitudinal members and the transverse members.

Preferably, both of each longitudinal member and each transverse member are long plate-shaped ribs, and the longitudinal members and the transverse members are connected at intersecting portions thereof.

More preferably, each contact member has protrusions, and the protrusions are inserted in holes formed in an associated one of the longitudinal members and the transverse members.

More preferably, the frame portion includes positioning grooves that receive opposite ends of the longitudinal members, and position the longitudinal members with respect to the frame portion, longitudinal member-fitting shafts that are at respective locations closer to central portions of the longitudinal members than the positioning grooves, and catch thereon longitudinal member cutouts formed in the opposite ends of the longitudinal members, and transverse member-fitting shafts that catch thereon transverse member cutouts formed in opposite ends of the transverse members.

Preferably, one of each longitudinal member and each transverse member is a long plate-shaped rib, and the other is a wire, the longitudinal members and the transverse members being connected at intersecting portions thereof.

More preferably, a recess formed in the each contact member is caught on each transverse member.

Preferably, one of each longitudinal member and each transverse member is long plate-shaped ribs, and the other is a pair of wires parallel to each other, the longitudinal members and the transverse members being connected at intersecting portions thereof.

More preferably, each contact member has recesses formed therein which correspond to the pair of wires, and the recesses are caught on the transverse members.

More preferably, each contact member includes a protrusion, and the protrusion is sandwiched between the pair of wires.

According to the present invention, it is possible to provide a connector that is capable of realizing a narrower pitch of contact members, and suppressing displacement of the contact members.

The above and other objects, features and advantages of the present invention will become more apparent from the following detailed description taken in conjunction with the accompanying drawings.

DETAILED DESCRIPTION OF THE PREFERRED EMBODIMENT

The present invention will now be described in detail with reference to the drawings showing preferred embodiments thereof.

First, a description will be given of a connector according to a first embodiment of the present invention, with reference to FIGS. 1 to 18.

Figure 16:
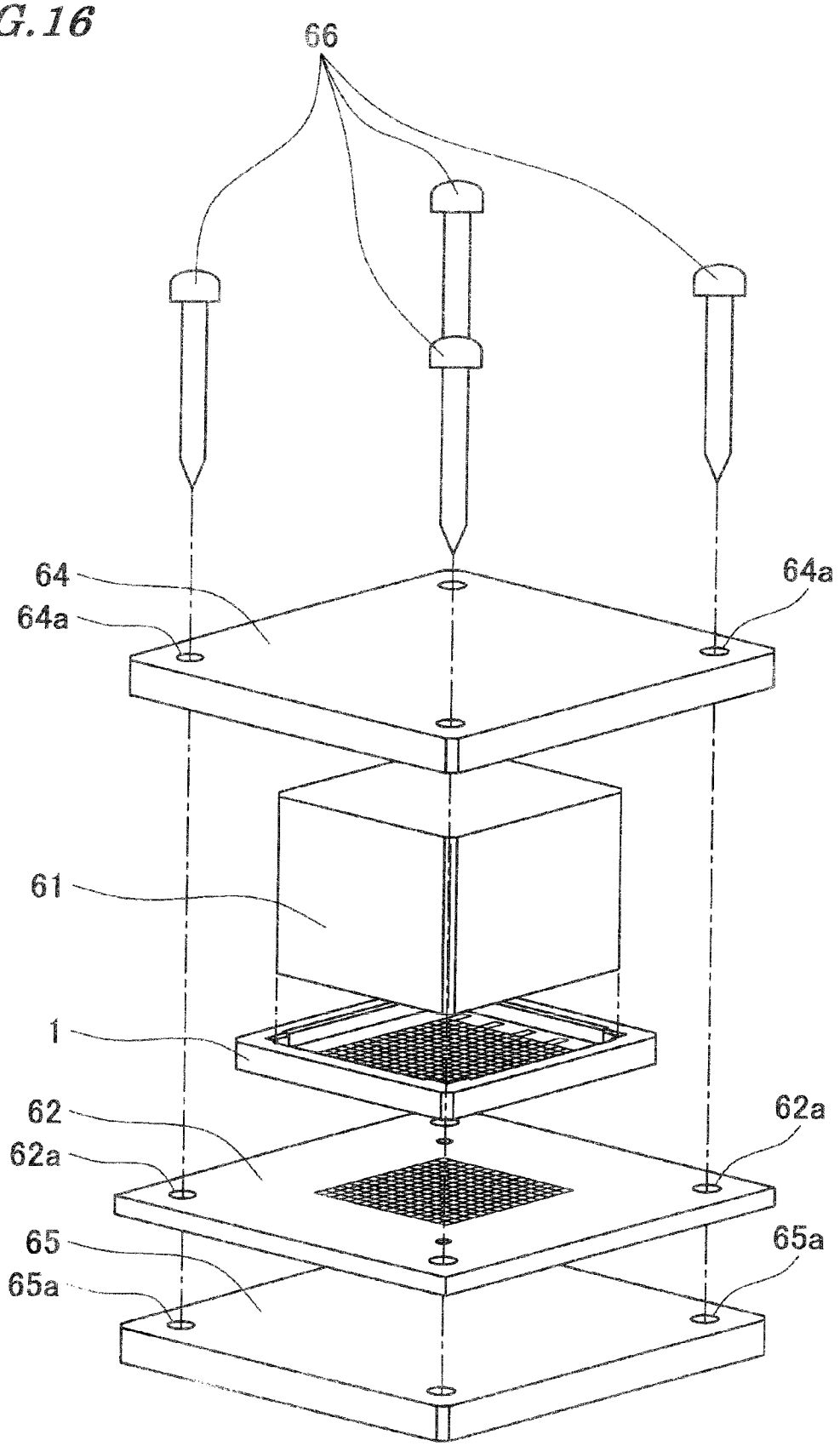
FIG. 16 is a perspective view of an IC package, a printed board, and the connector shown in FIG. 1, in a state before the IC package and the printed board are electrically connected by the connector.

As shown in FIG. 16, the connector, denoted by reference numeral 1, is used for electrically connecting between an IC package (first object to be connected) 61 and a printed board (second object to be connected) 62.

Figure 1:
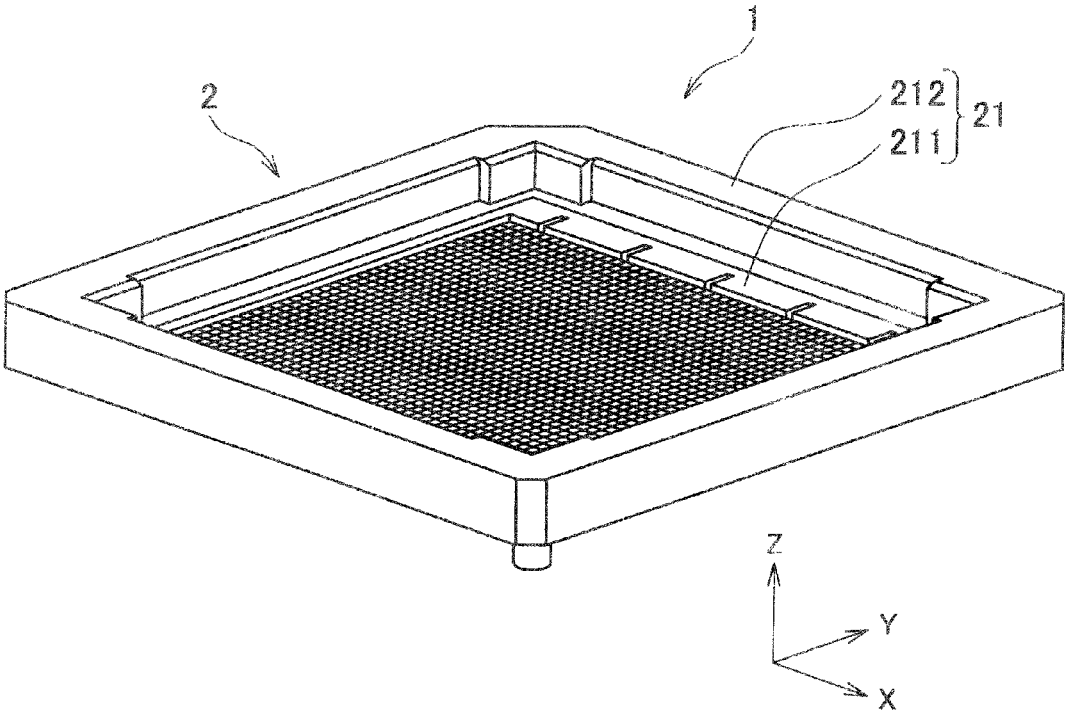
FIG. 1 is a perspective view of a connector according to a first embodiment of the present invention.
Figure 2:
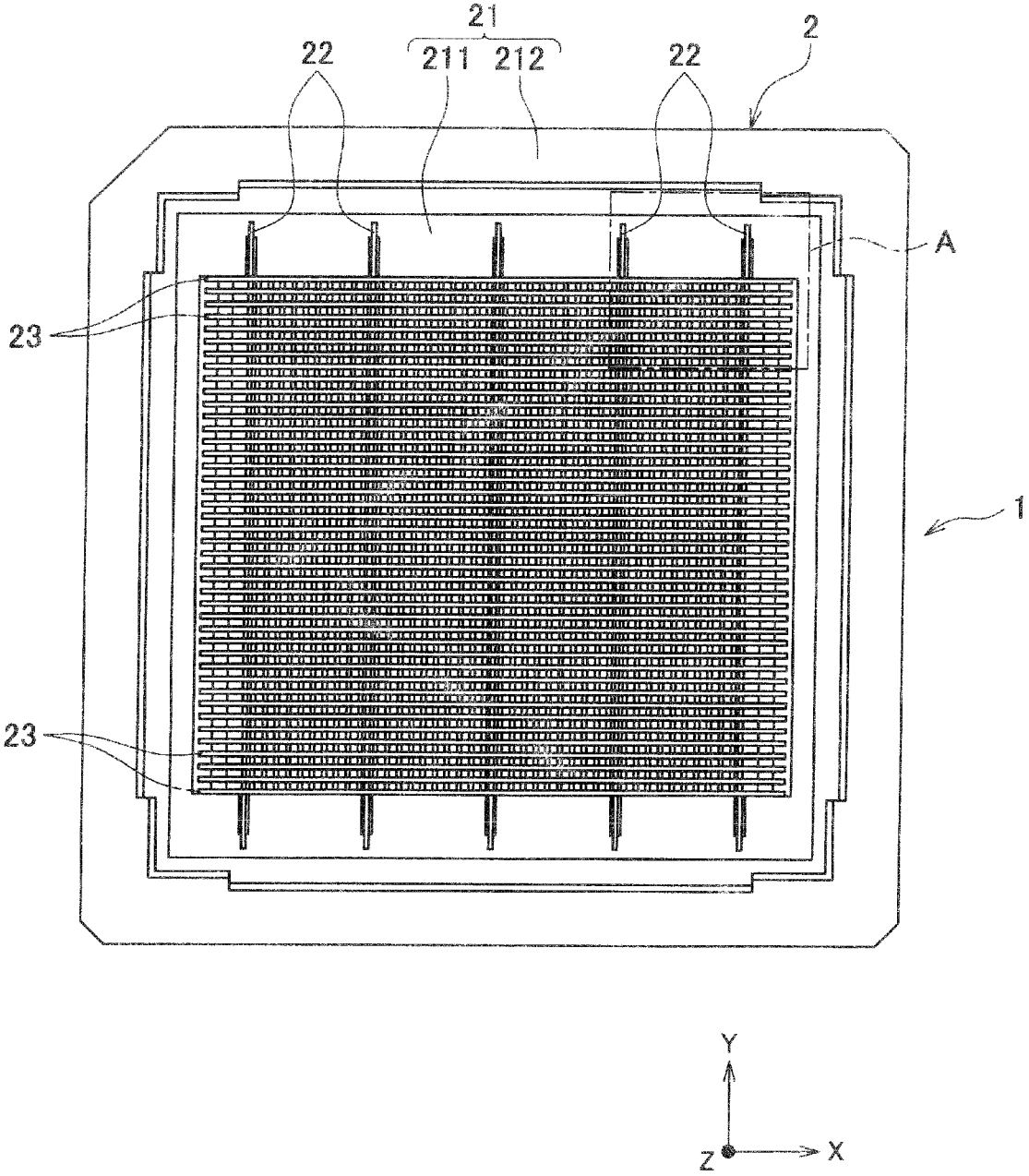
FIG. 2 is a plan view of the connector shown in FIG. 1.
Figure 3:
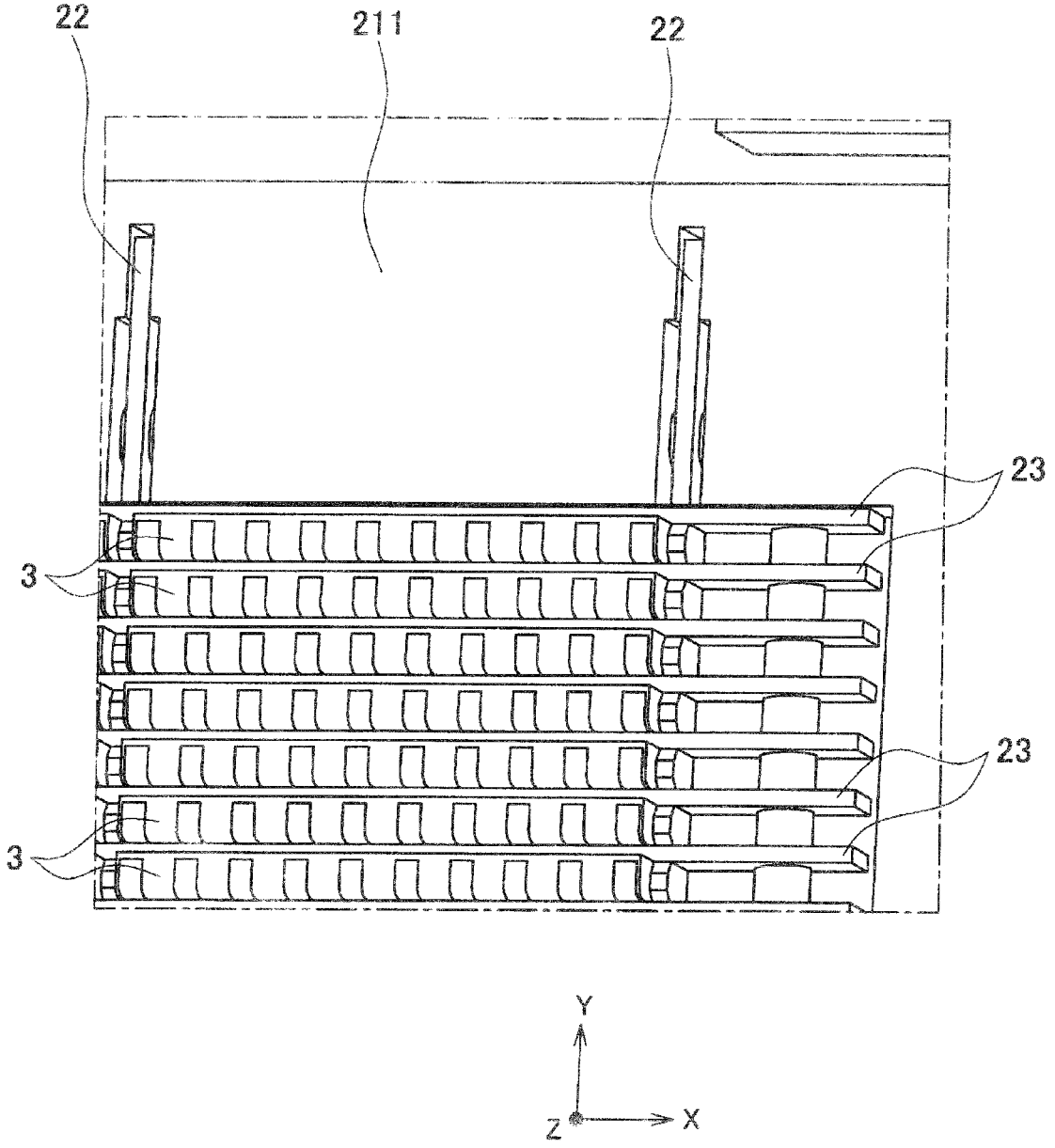
FIG. 3 is an enlarged view of a portion A in FIG. 2, as viewed obliquely from above.

As shown in FIGS. 1 to 3, the connector 1 comprises a frame 2 and a plurality of contact members 3. The plurality of contact members 3 are sandwiched between the IC package 61 and the printed board 62, shown in FIG. 16, and are elastically deformed.

Figure 11:
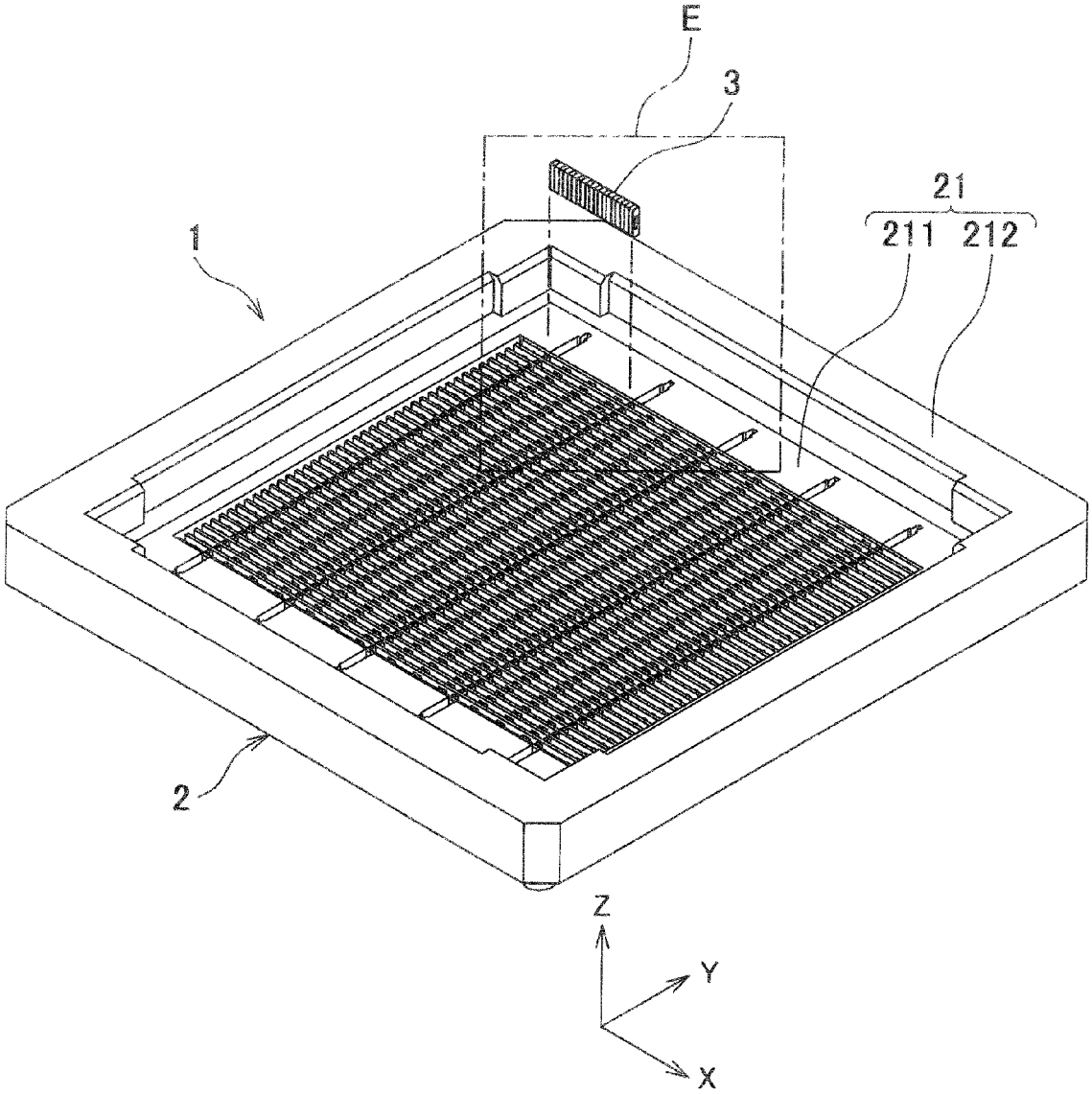
FIG. 11 is a perspective view of the connector shown in FIG. 1 in a state before a contact member is inserted into an associated one of slits of the frame.
Figure 12:
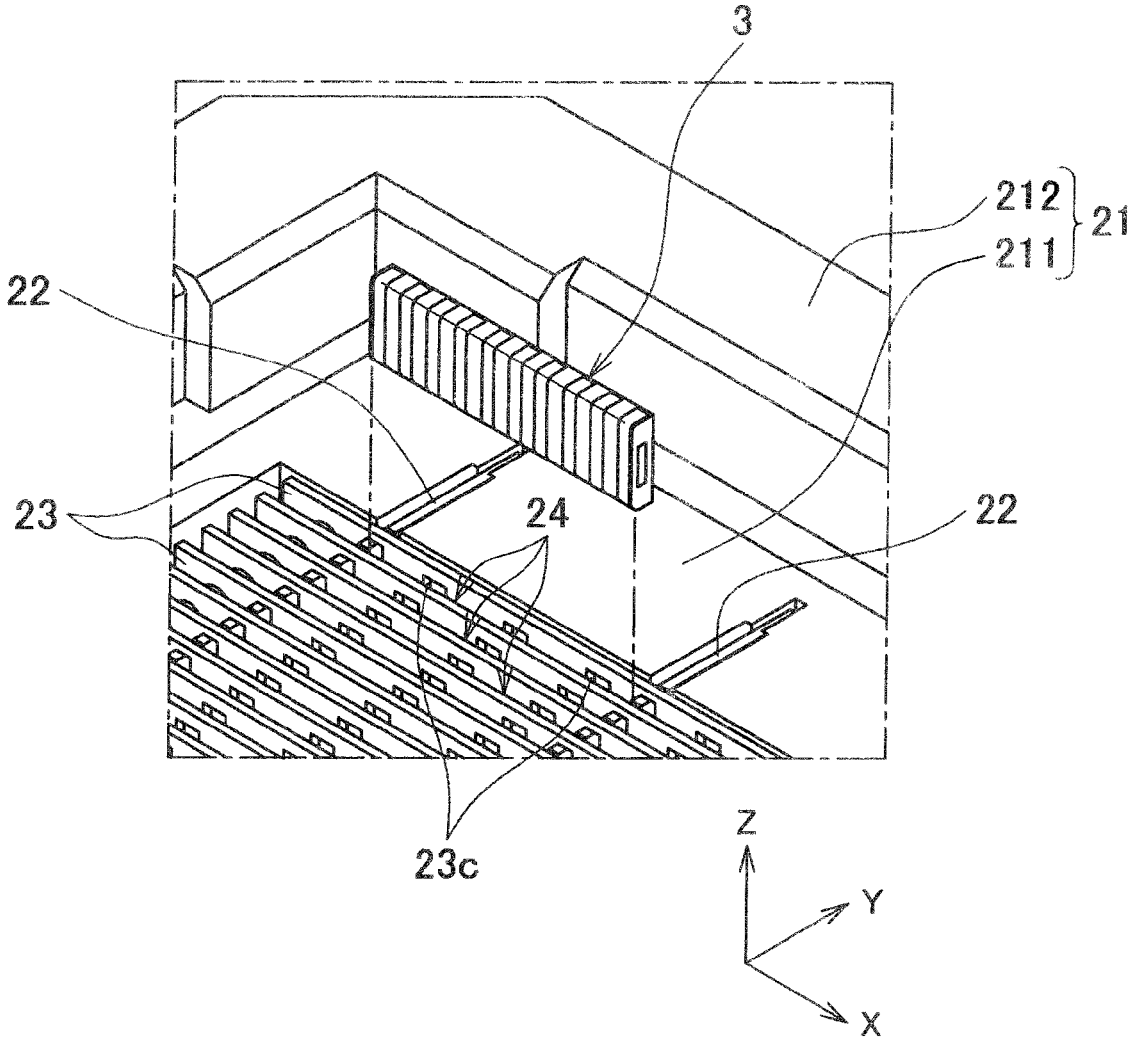
FIG. 12 is an enlarged view of a portion E in FIG. 11.

As shown in FIGS. 11 and 12, the frame 2 includes a frame portion 21, a plurality of longitudinal ribs (longitudinal members) 22, and a plurality of transverse ribs (transverse members) 23.

Figure 4:
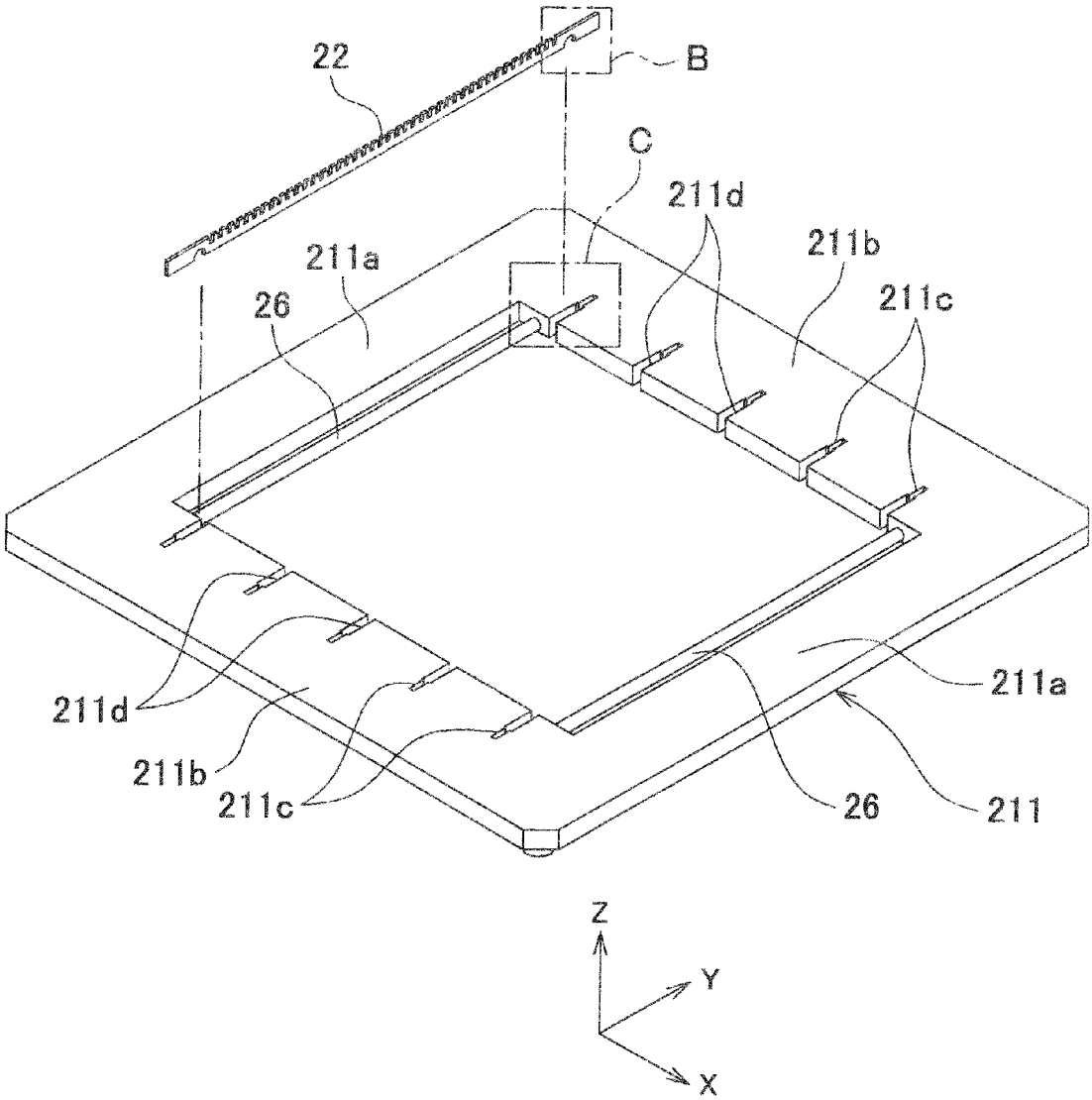
FIG. 4 is a perspective view of a frame main body of a frame of the connector shown in FIG. 1 in a state before a longitudinal rib is assembled thereto.

The frame portion 21 is formed by a frame main body 211 and an outer frame 212. As shown in FIG. 4, the frame main body 211 is a flat rectangular frame. A pair of transverse boards 211*b* of the frame main body 211 are each formed with a plurality of positioning grooves 211*c* at equally-spaced intervals. Each positioning groove 211*c* extends in a longitudinal direction Y. Each pair of opposite positioning grooves 211*c* receive respective opposite ends of one longitudinal rib 22 to thereby position the one longitudinal rib 22 with respect to the frame portion 21. Further, the pair of transverse boards 211*b* of the frame main body 211 are each formed with a plurality of wide grooves 211*d*. Each wide groove 211*d* is at a location closer to the central portion of the longitudinal rib 22 than the associated positioning groove 211*c*, and is continuous with the associated positioning groove 211*c*. Each wide groove 211*d* is provided with a longitudinal member-fitting shaft 25 such that the longitudinal member-fitting shaft 25 extends in a manner crossing the wide groove 211*d* (see FIG. 6). The longitudinal member-fitting shaft 25 extends parallel to the transverse boards 211*b*. A pair of transverse member-fitting shafts 26 extend between the pair of transverse boards 211*b* in a bridging manner (see FIG. 4). The pair of transverse member-fitting shafts 26 are at locations near a pair of longitudinal boards 211*a*, respectively. The transverse member-fitting shafts 26 extend parallel to the longitudinal boards 211*a*.

Figure 10:
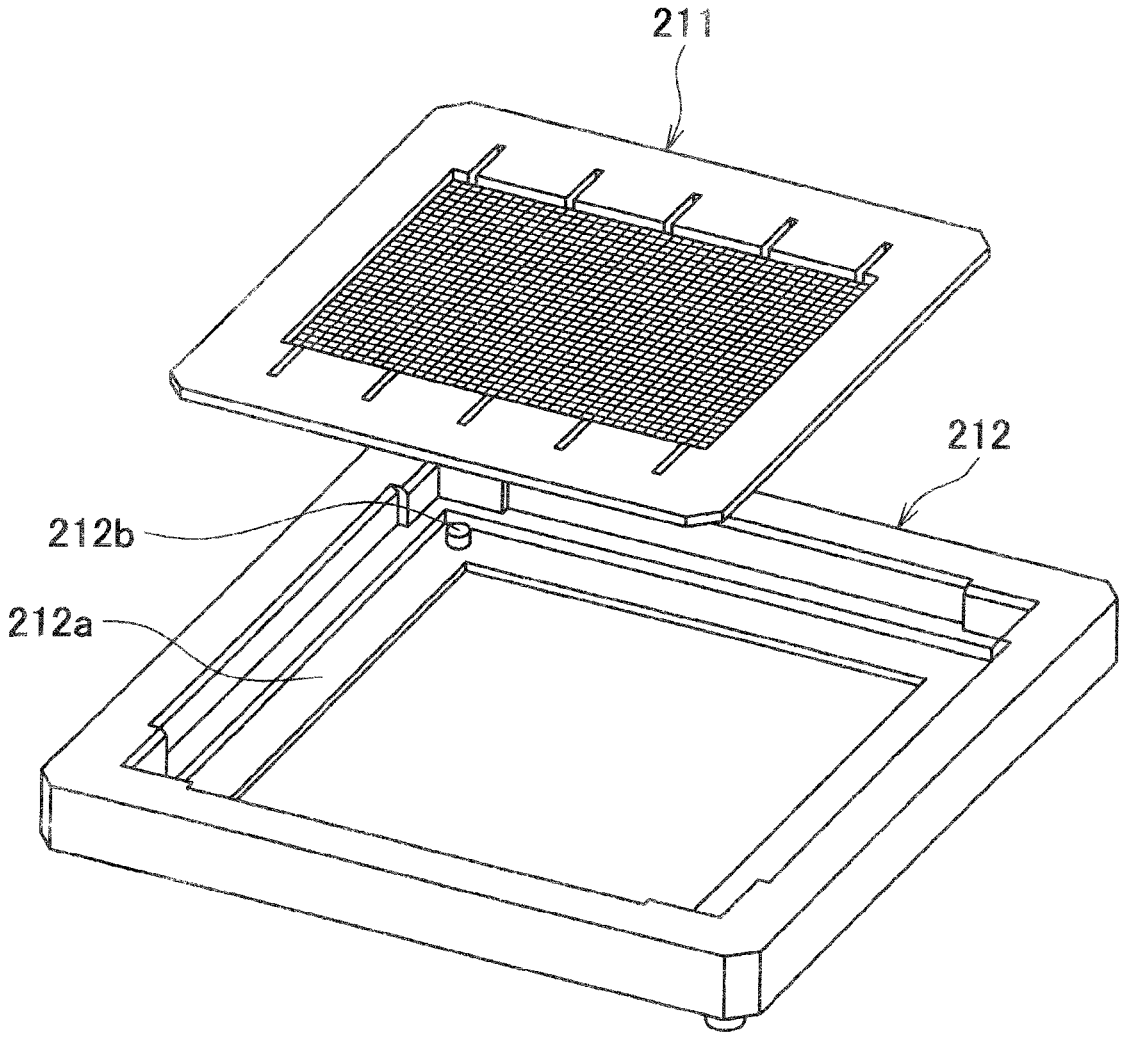
FIG. 10 is a perspective view of an outer frame in a state before the frame main body appearing in FIG. 9 is assembled thereto.

The outer frame 212 is a rectangular frame. The outer frame 212 receives and accommodates a lower part of the IC package 61. The outer frame 212 has a bottom portion formed with a recess 212*a* (see FIG. 10). The recess 212*a* accommodates and holds the frame main body 211. As shown in FIG. 10, the recess 212*a* is provided with two positioning pins 212*b* (only one of the pins 212*b* is shown in FIG. 10). The pins 212*b* are fitted in recesses (not shown) formed in two corners of the bottom surface of the frame main body 211, respectively. The frame main body 211 and the outer frame 212 are molded e.g. of respective insulating materials.

Each longitudinal rib 22 is a rib that extends from one of the transverse boards 211*b* of the frame main body 211 to the other in a bridging manner. The longitudinal rib 22 extends in the longitudinal direction Y. The longitudinal rib 22 is long plate-shaped. The longitudinal rib 22 has an upper end portion formed with a plurality of grooves 22*a* at equally-spaced intervals. Further, the longitudinal rib 22 has opposite ends in a direction along the length thereof formed with cutouts (longitudinal member-side cutouts) 22*b*. The cutouts 22*b* are each substantially arc-shaped so as to be caught on the longitudinal member-fitting shafts 25 associated therewith, respectively (see FIGS. 5 and 6).

Each transverse rib 23 is a rib which extends orthogonal to the frame portion 21 from one of the longitudinal boards 211*a* of the frame main body 211 to the other in a bridging manner. Each transverse rib 23 extends in a transverse direction X. Each transverse rib 23 is long plate-shaped. Each transverse rib 23 has a lower end portion formed with a plurality of grooves 23*a* at equally-spaced intervals (see FIG. 8). The groves 23*a* of the transverse rib 23 are meshed with associated ones of the grooves 22*a* of the longitudinal ribs 22. As a result, the longitudinal ribs 22 and transverse ribs 23 are connected at intersecting portions thereof. Further, each transverse rib 23 has opposite ends in a direction along the length thereof formed with cutouts (transverse member-side cutouts) 23*b*, respectively. The cutouts 23*b* are each substantially arc-shaped so as to be caught on the transverse member-fitting shafts 26, respectively (see FIG. 8). Further, each transverse rib 23 is formed with holes 23*c* at predetermined spaced-intervals.

As shown in FIG. 12, a plurality of slits 24 are defined by the plurality of longitudinal ribs 22 and the plurality of transverse ribs 23 which have been assembled to the frame portion 21. One contact member 3 is held in each one slit 24. The contact members 3 are held in the slits 24, respectively, in a removable manner, and hence if part of the contact members 3 becomes unusable e.g. due to breakage, only the broken contact member 3 can be replaced by a new contact member 3. This makes it possible to repair the connector 1, and reduce the costs compared with a case where the whole connector 1 is replaced.

Each of the longitudinal ribs 22 and the transverse ribs 23 has insulation properties. Each of the longitudinal ribs 22 and the transverse ribs 23 is formed of a material mainly composed of e.g. polyimide, and is higher in rigidity than the frame portion 21. Other examples of the longitudinal ribs 22 and the transverse ribs 23 each having insulation properties include one prepared by forming a metal plate (not shown) having the same shape as that of each of the longitudinal ribs 22 and the transverse ribs 23, and performing insulation coating on a surface of the metal plate.

Figure 13:
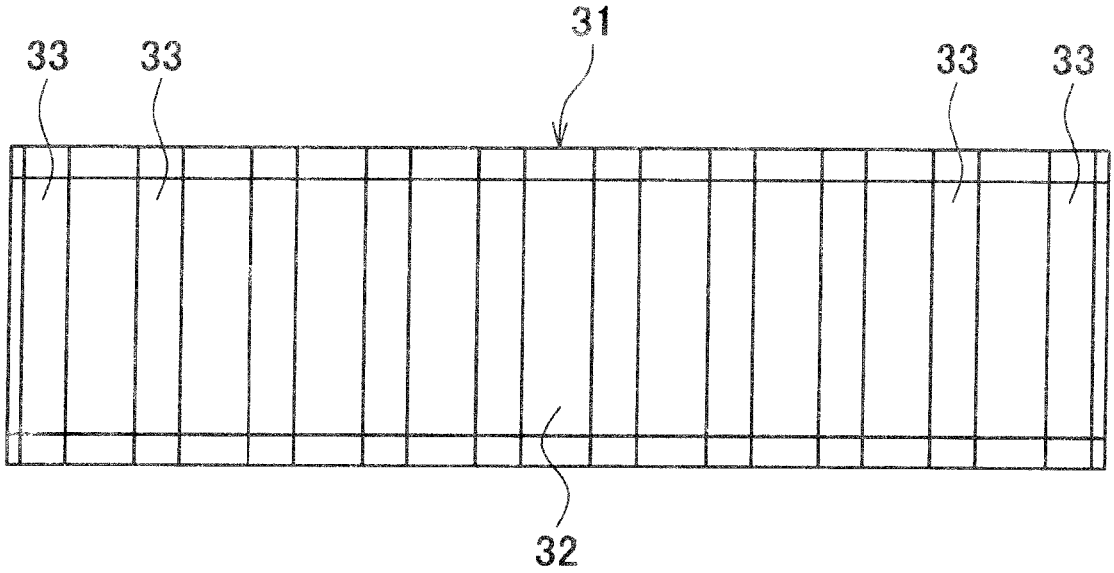
FIG. 13 is a front view of the contact member of the connector shown in FIG. 1.
Figure 14:
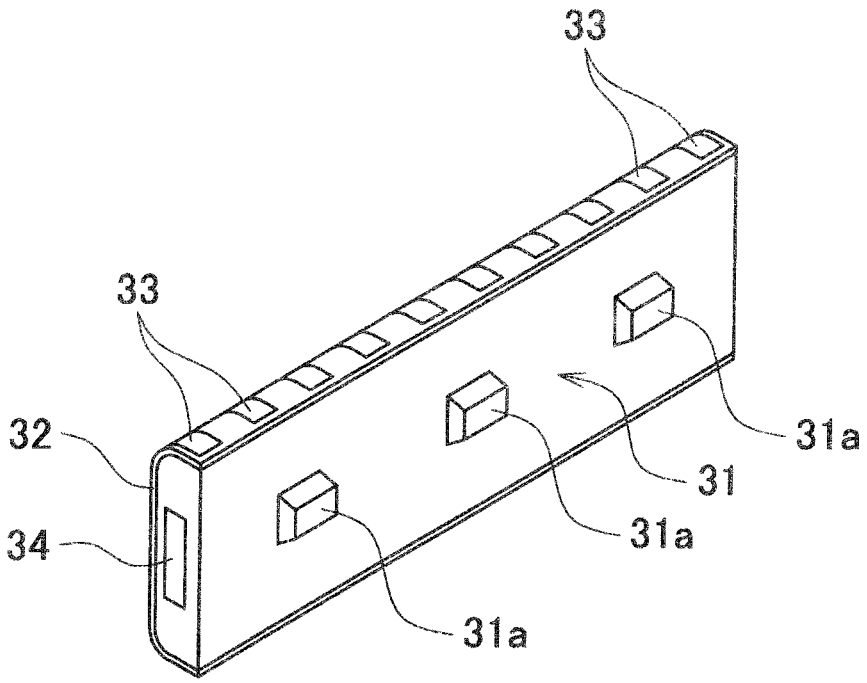
FIG. 14 is a perspective view of the contact member shown in FIG. 13, as viewed obliquely from the rear.

As shown in FIGS. 13 and 14, each contact member 3 includes an insulating elastic member 31, an insulating film 32, and a plurality of conductive path portions 33. The insulating elastic member 31 is long plate-shaped, and has a D-shaped cross section. The insulating elastic member 31 has a flat rear surface formed with three protrusions 31*a*. When each contact member 3 is accommodated in an associated one of the slits 24, the protrusions 31*a* are inserted in the holes 23*c* of an associated one of the transverse ribs 23, respectively, whereby each contact member 3 is held in the associated slit 24. A core 34 is embedded in the insulating elastic member 31. The core 34 is long plate-shaped (see FIG. 15A). The insulating elastic member 31 is formed of a material mainly composed of e.g. rubber. The insulating film 32 is bonded to the insulating elastic member 31 to cover an upper surface, a front surface, and a lower surface of the insulating elastic member 31. The plurality of conductive path portions 33 are formed on the insulating film 32 at equally-spaced intervals using a production method, such as etching or plating, and each extend from the upper surface to the lower surface of the insulating film 32. Each conductive path portion 33 electrically connects between a terminal portion (first terminal portion) 61*c* formed on the IC package 61, and a terminal portion (second terminal portion) 62*c* formed on the printed board 62.

Next, a description will be given of how to assemble the connector 1.

Figure 5:
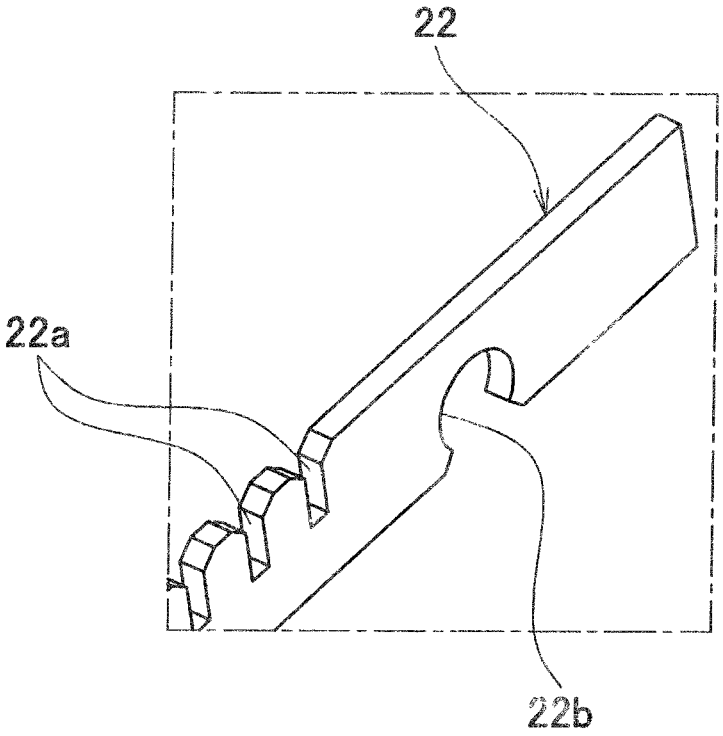
FIG. 5 is an enlarged view of a portion B in FIG. 4.
Figure 6:
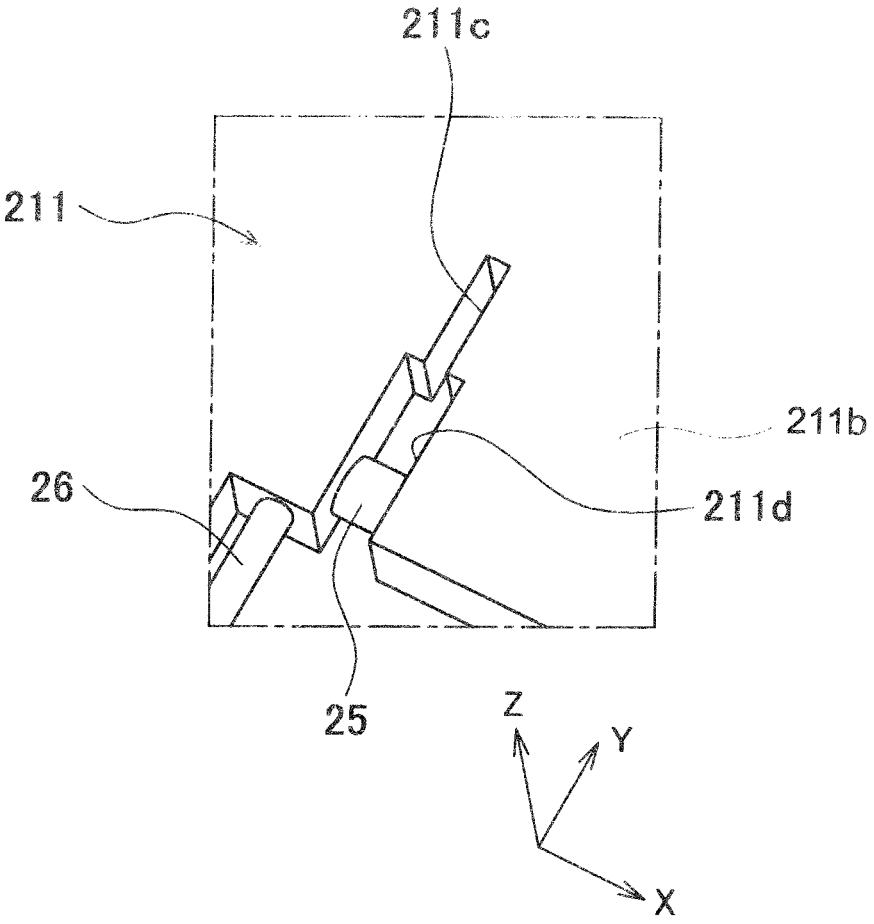
FIG. 6 is an enlarged view of a portion C in FIG. 4.

First, as shown in FIGS. 4 to 6, the opposite ends of each longitudinal rib 22 are each inserted in the associated positioning groove 211*c* and wide groove 211*d* of the frame main body 211, and the cutouts 22*b* of the longitudinal rib 22 are each fitted on the associated longitudinal member-fitting shaft 25. As a result, the longitudinal rib 22 is positioned in the transverse direction X by the associated positioning grooves 211*c*, and in the longitudinal direction Y by the longitudinal member-fitting shafts 25, and is prevented from being removed from the frame main body 211.

Figure 7:
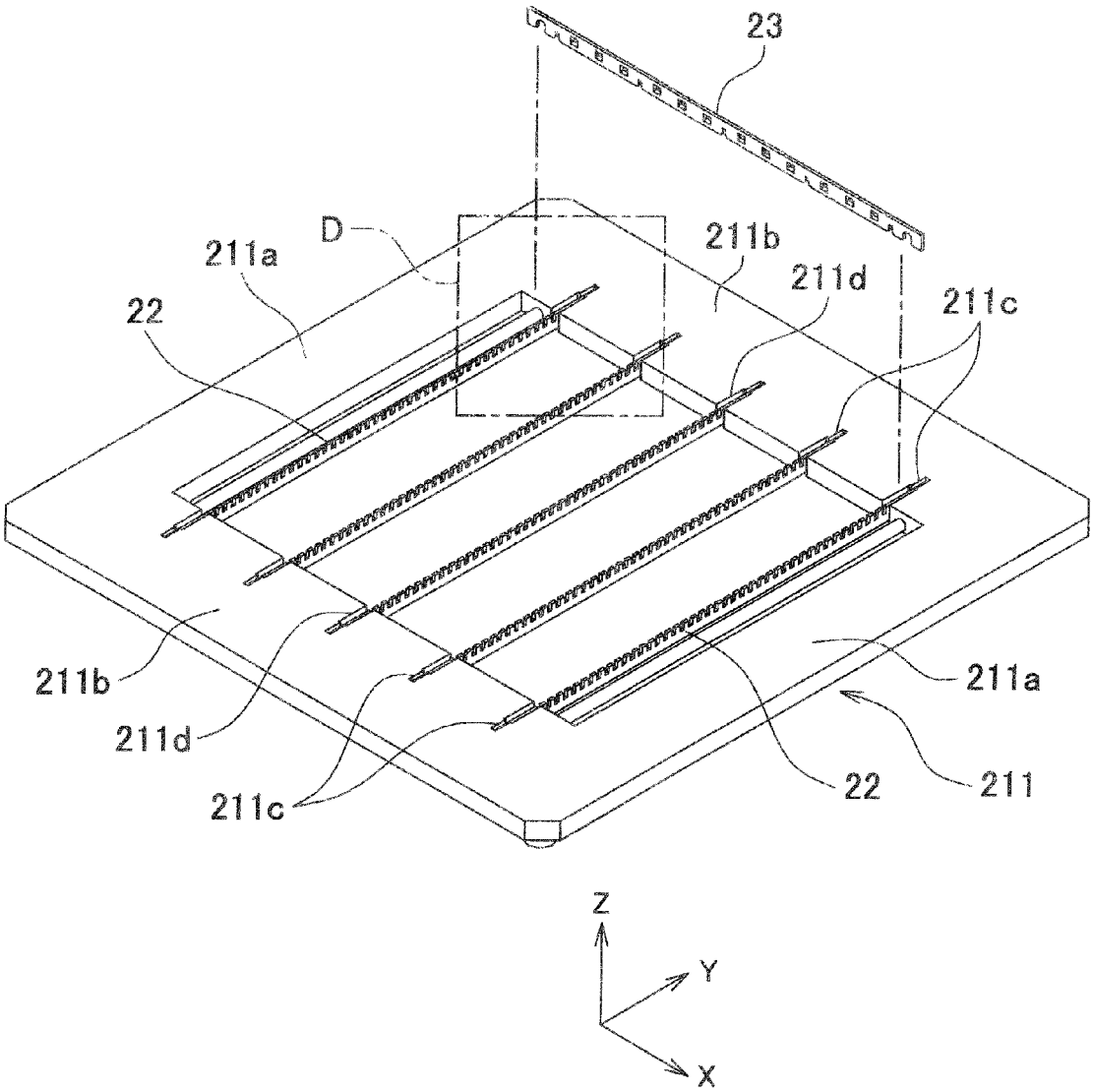
FIG. 7 is a perspective view of the frame main body of the frame of the connector shown in FIG. 1 in a state before a transverse rib is assembled thereto.
Figure 8:
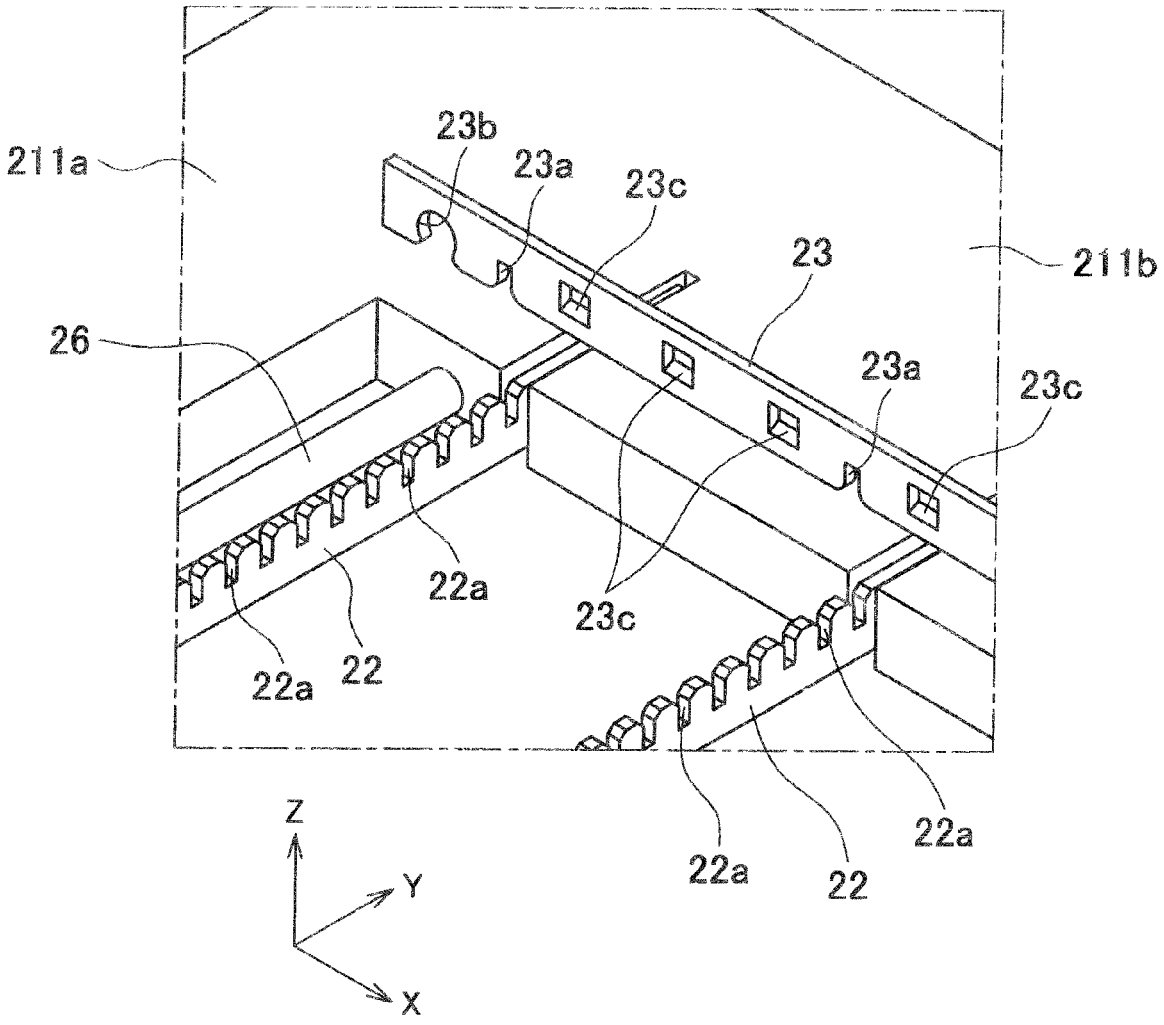
FIG. 8 is an enlarged view of a portion D in FIG. 7.

Next, as shown in FIGS. 7 and 8, each transverse rib 23 is assembled to the longitudinal ribs 22. At this time, each transverse rib 23 is assembled to the longitudinal ribs 22 in such a manner that the grooves 23*a* of each transverse rib 23 are meshed with associated ones of the grooves 22*a* of the longitudinal ribs 22, and the cutouts 23*b* of the same are fitted on the transverse member-fitting shafts 26 from above, respectively. The grooves 23*a* of the transverse rib 23 are meshed with the grooves 22*a* of the longitudinal ribs 22 to thereby position the transverse rib 23 (in the transverse direction X and the longitudinal direction Y), and the cutouts 23*b* are fitted on the transverse member-fitting shafts 26 to thereby prevent the transverse rib 23 from being removed from the frame main body 211.

Figure 9:
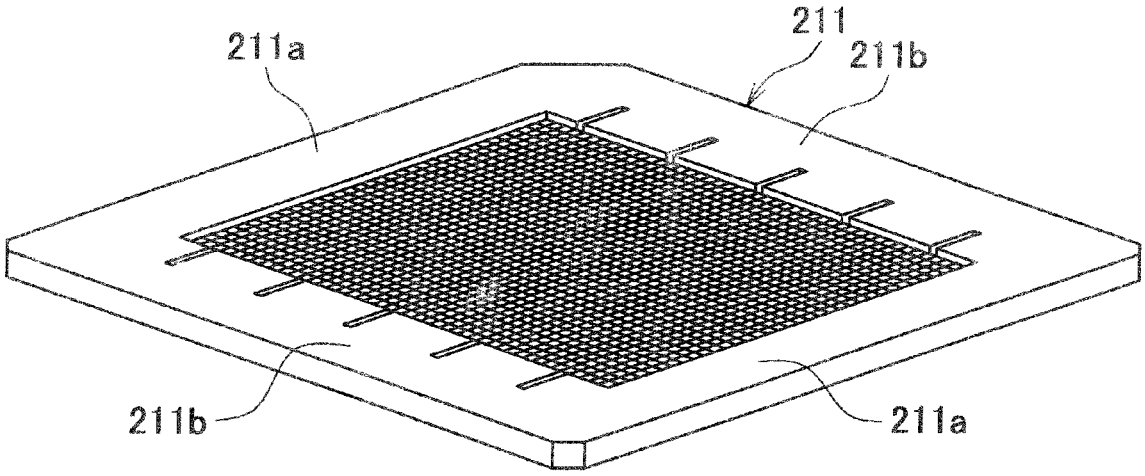
FIG. 9 is a perspective view of the frame main body of the frame of the connector shown in FIG. 1 in a state having the longitudinal ribs and the transverse ribs assembled thereto.

When the above-described operations are through, assembly of the longitudinal ribs 22 and the transverse ribs 23 to the frame main body 211, as shown in FIG. 9, is completed.

Next, the frame main body 211 is received into the recess 212*a* of the outer frame 212, as shown in FIG. 10. In doing this, the two pins 212*b* are caused to be inserted into the recesses (not shown) formed in the two diagonally opposite corners of the bottom surface of the frame main body 211, respectively. As a result, the frame main body 211 is positioned with respect to the outer frame 212.

Finally, as shown in FIGS. 11 and 12, the contact members 3 are inserted into the plurality of slits 24, respectively, from a direction Z of height. In doing this, the protrusions 31*a* of the insulating elastic members 31 of each contact member 3 are caused to be inserted in the associated holes 23*c* of the transverse rib 23, respectively.

When the above-described working process is finished, assembly of the connector 1 is completed.

Next, a description will be given of a method of manufacturing the contact members 3.

Figure 15A:
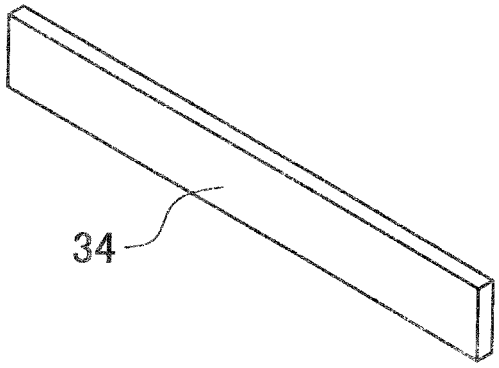
FIG. 15A is a perspective view of a core of the contact member shown in FIG. 14.
Figure 15B:
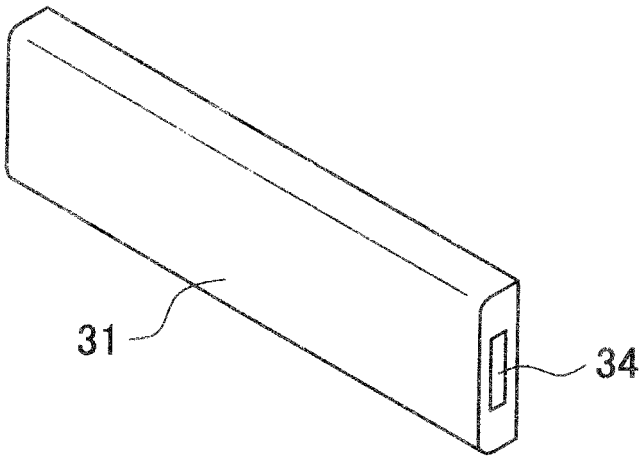
FIG. 15B is a perspective view of an insulating elastic member in a state having the core shown in FIG. 15A embedded therein.

As shown in FIGS. 15A and 15B, first, the insulating elastic member 31 is formed such that the core 34 is embedded by the insert molding or the compression molding.

Figure 15C:
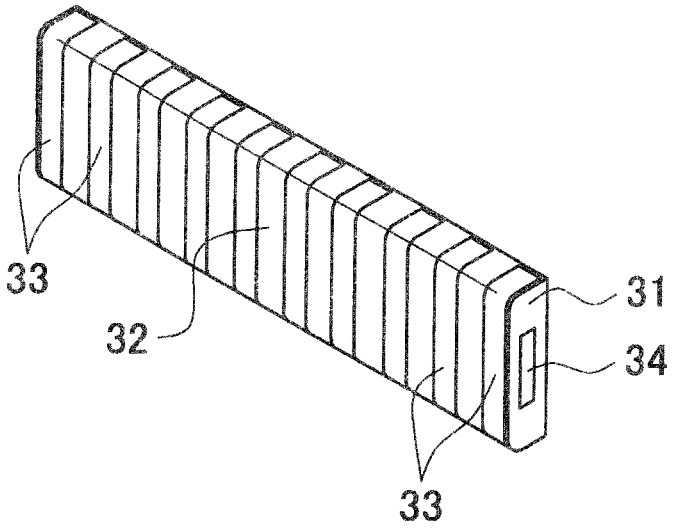
FIG. 15C is a perspective view of the insulting elastic member in a state having an insulating film affixed thereto.

Then, as shown in FIG. 15C, the insulating film 32 on which the conductive path portions 33 are formed at equally-spaced intervals is affixed to the insulating elastic members 31 such that the insulating film 32 covers the upper surface, the front surface, and the lower surface of the insulating elastic member 31.

Thus, each contact member 3 is manufactured.

Figure 17:
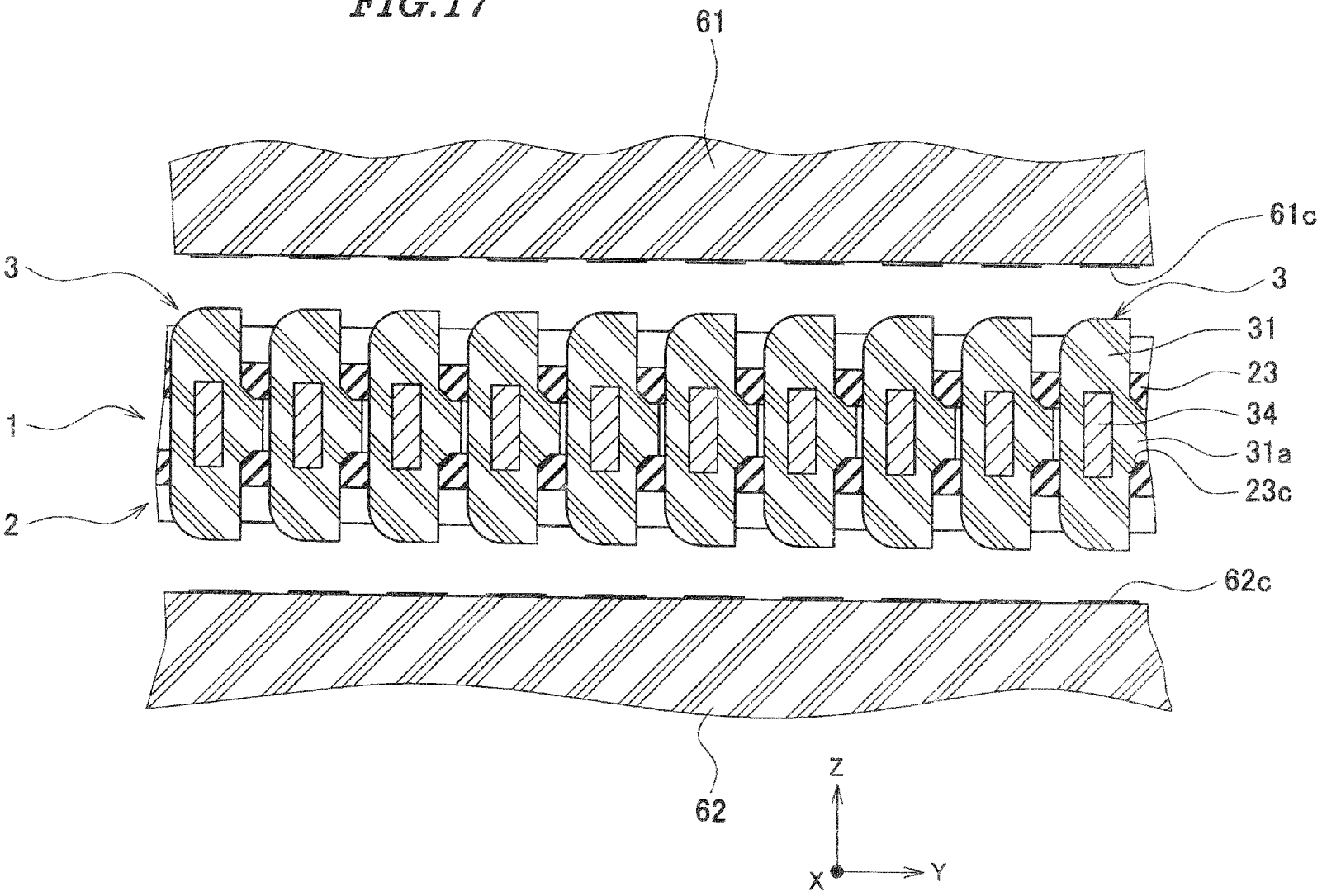
FIG. 17 is a partial enlarged cross-sectional view of the IC package, the printed board, and the connector shown in FIG. 1, in the state before the IC package and the printed board are electrically connected by the connector.

Next, a description will be given of how to use the connector 1, with reference to FIGS. 16 and 17.

As shown in FIG. 16, the printed board 62, the connector 1, the IC package 61, and an upper stiffener 64 are sequentially arranged on a lower stiffener 65, one upon another. Then, screws 66 are inserted through holes 64*a* of the upper stiffener 64 and holes 62*a* of the printed board 62, and ends of the screws 66 are screwed into screw holes 65*a* of the lower stiffener 65, respectively.

Figure 18:
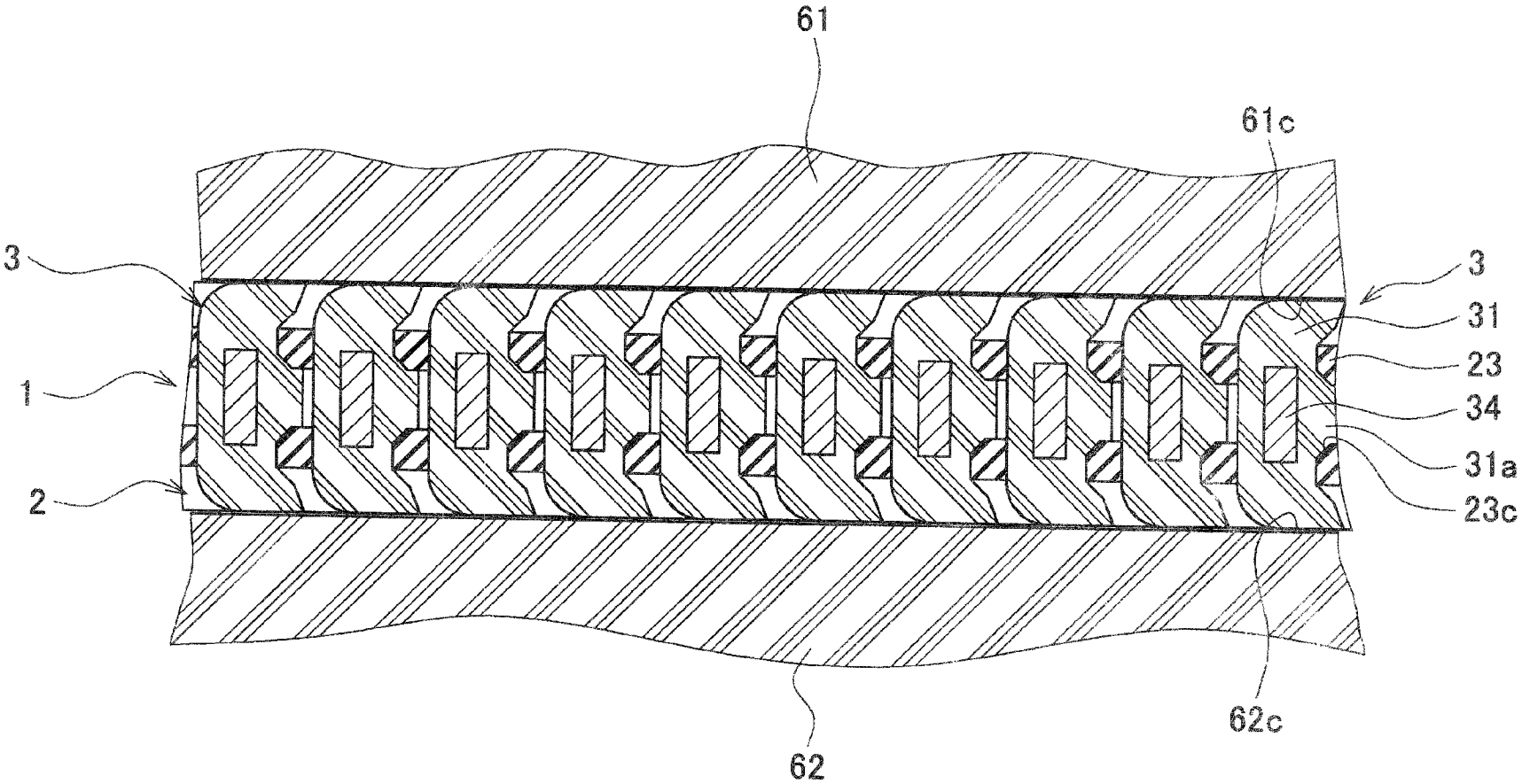
FIG. 18 is a partial enlarged cross-sectional view of the IC package, the printed board, and the connector shown in FIG. 1, in a state the IC package and the printed board are electrically connected by the connector.

As a result, as shown in FIG. 18, the connector 1 is sandwiched between the IC package 61 and the printed board 62, whereby the contact members 3 are compressed, and the conductive path portions 33 of the contact members 3 electrically connect the terminal portions 61*c* of the IC package 61 and the terminal portions 62*c* of the printed board 62.

According to the present embodiment, since the frame 2 is formed by assembling three kinds of components (the frame portion 21, the longitudinal ribs 22, and the transverse ribs 23), it is possible to make the rigidity of the longitudinal ribs 22 and the transverse ribs 23 higher than that of the frame portion 21, and even when a narrower pitch of the contact members 3 is realized by reducing the thickness of each of the longitudinal ribs 22 and the transverse ribs 23, it is possible to prevent the longitudinal ribs 22 and the transverse ribs 23 from being deformed when the contact members 3 are compressed, which makes it possible to suppress displacement of the positions of the contact members 3.

Further, the degree of freedom of processing the longitudinal ribs 22 and the transverse ribs 23 is increased. This makes it possible to provide the holes 23*c* in each transverse rib 23, and insert the protrusions 31*a* of each contact member 3 in the holes 23*c*, whereby each contact member 3 can be reliably held.

Further, when any of the contact members 3, the longitudinal ribs 22, and the transverse ribs 23 is damaged, only the damaged one of the contact members 3, the longitudinal ribs 22, and the transverse ribs 23 can be replaced, and hence it is possible to easily repair the connector 1.

Next, a description will be given of a first variation of the connector according to the first embodiment of the present invention, with reference to FIG. 19.

Components identical to those in the above-described first embodiment are denoted by the same reference numerals, and description thereof is omitted. Hereafter, only main differences from the first embodiment will be described.

Figure 19:
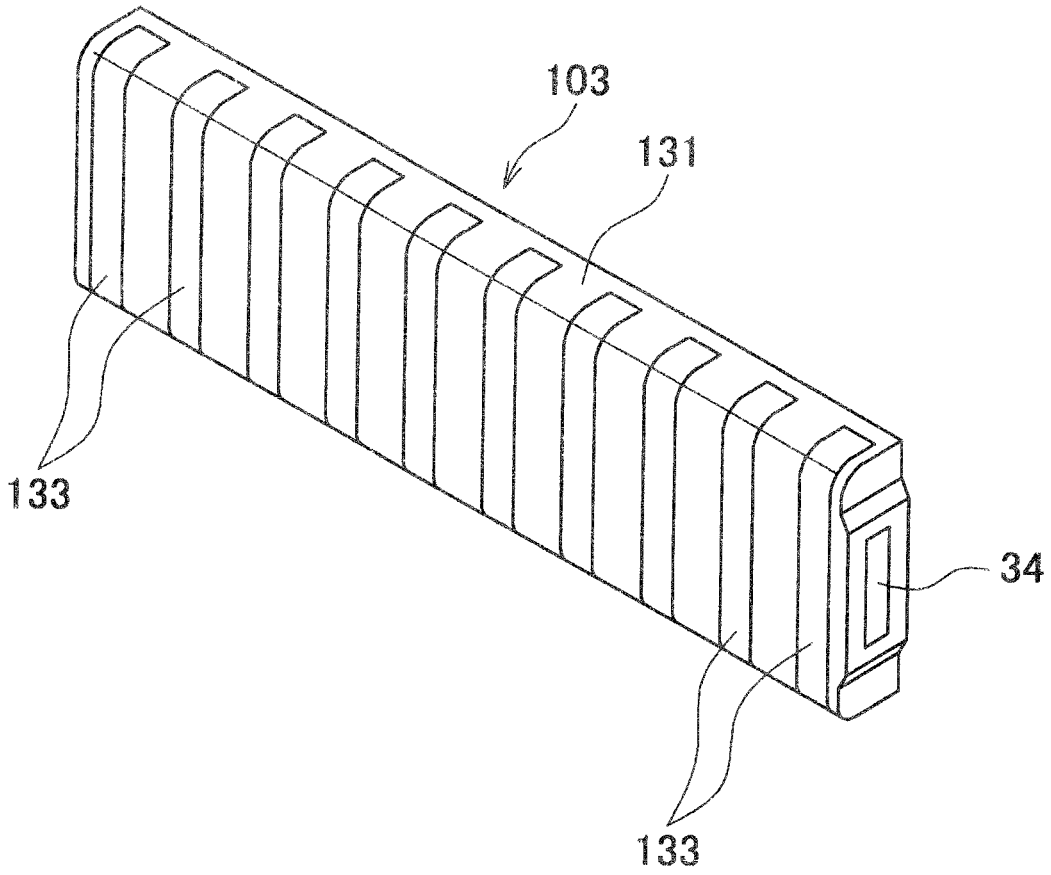
FIG. 19 is a perspective view of a contact member of a connector according to a first variation of the first embodiment.

As shown in FIG. 19, in this variation, conductive path portions 133 are directly formed on an insulating elastic member 131 of each contact member 103 e.g. by sputtering. Except the structure of each contact member 103, the first variation has the same arrangement as that of the first embodiment.

According to the first variation, it is possible to obtain the same advantageous effects as provided by the first embodiment.

Next, a description will be given of a second variation of the connector according to the first embodiment of the present invention, with reference to FIGS. 20 and 21.

Components identical to those in the above-described first embodiment are denoted by the same reference numerals, and description thereof is omitted. Hereafter, only main differences from the first embodiment will be described.

Figure 20:
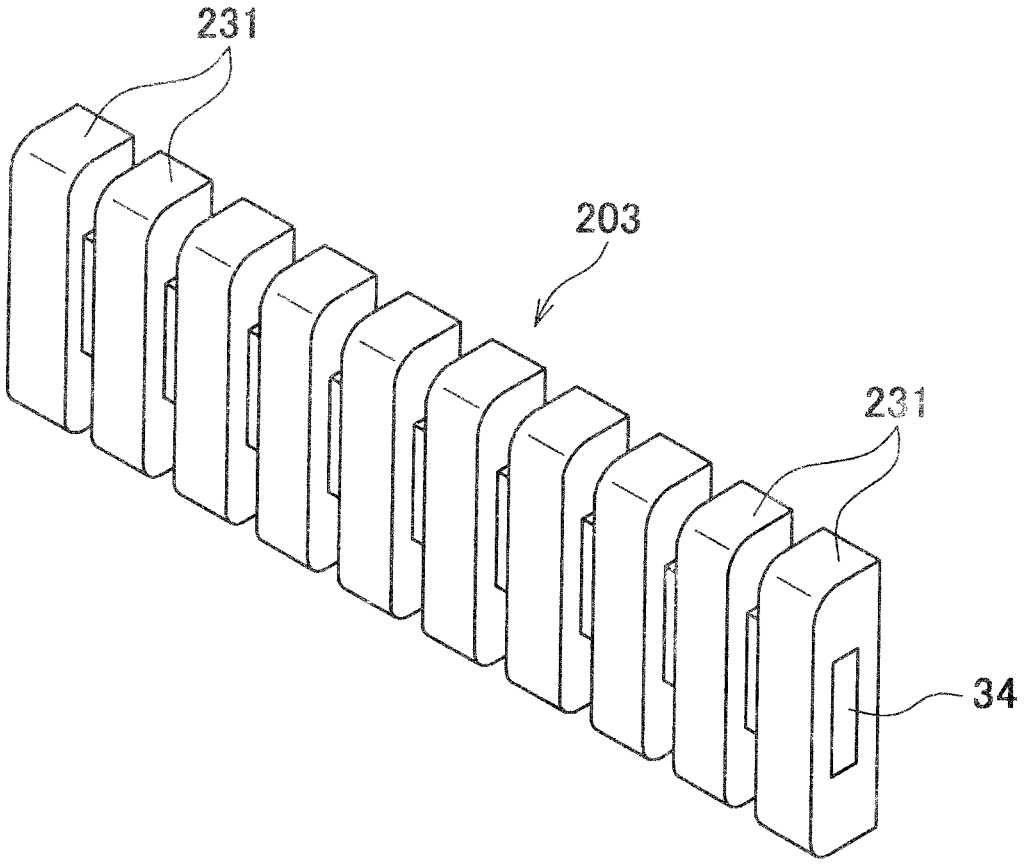
FIG. 20 is a perspective view of a contact member of a connector according to a second variation of the first embodiment.
Figure 21:
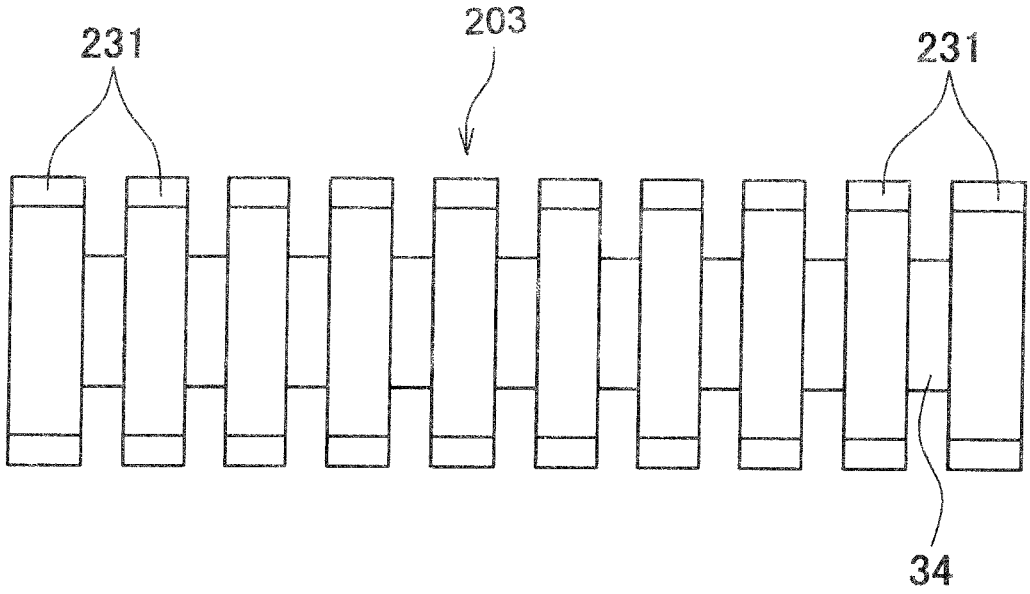
FIG. 21 is a front view of the contact member of the connector according to the second variation of the first embodiment.

As shown in FIGS. 20 and 21, in this variation, each contact member 203 is composed of the core 34 and conductive elastic members (conductive path portions) 231 arranged on the core 34 at equally-spaced intervals. Except the structure of the contact member 203, the second variation has the same arrangement as that of the first embodiment.

According to the second variation, it is possible to obtain the same advantageous effects as provided by the first embodiment.

Figure 22:
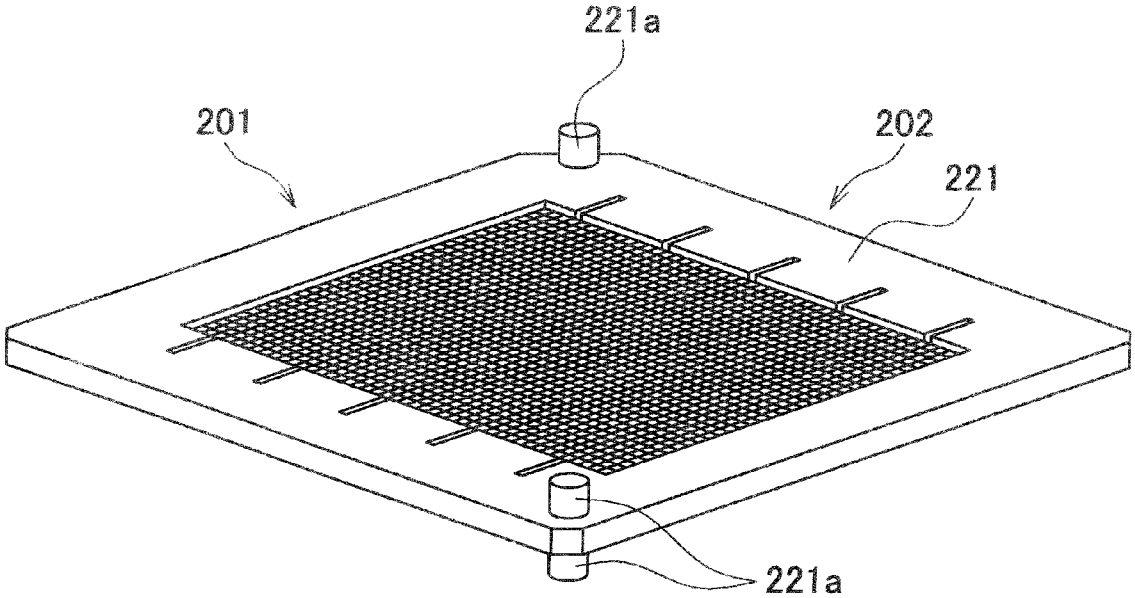
FIG. 22 is a perspective view of a connector according to a second embodiment of the present invention.

Next, a description will be given of a connector 201 according to a second embodiment of the present invention, with reference to FIGS. 22 and 23.

Components identical to those in the above-described first embodiment are denoted by the same reference numerals, and description thereof is omitted. Hereafter, only main differences from the first embodiment will be described.

Figure 23:
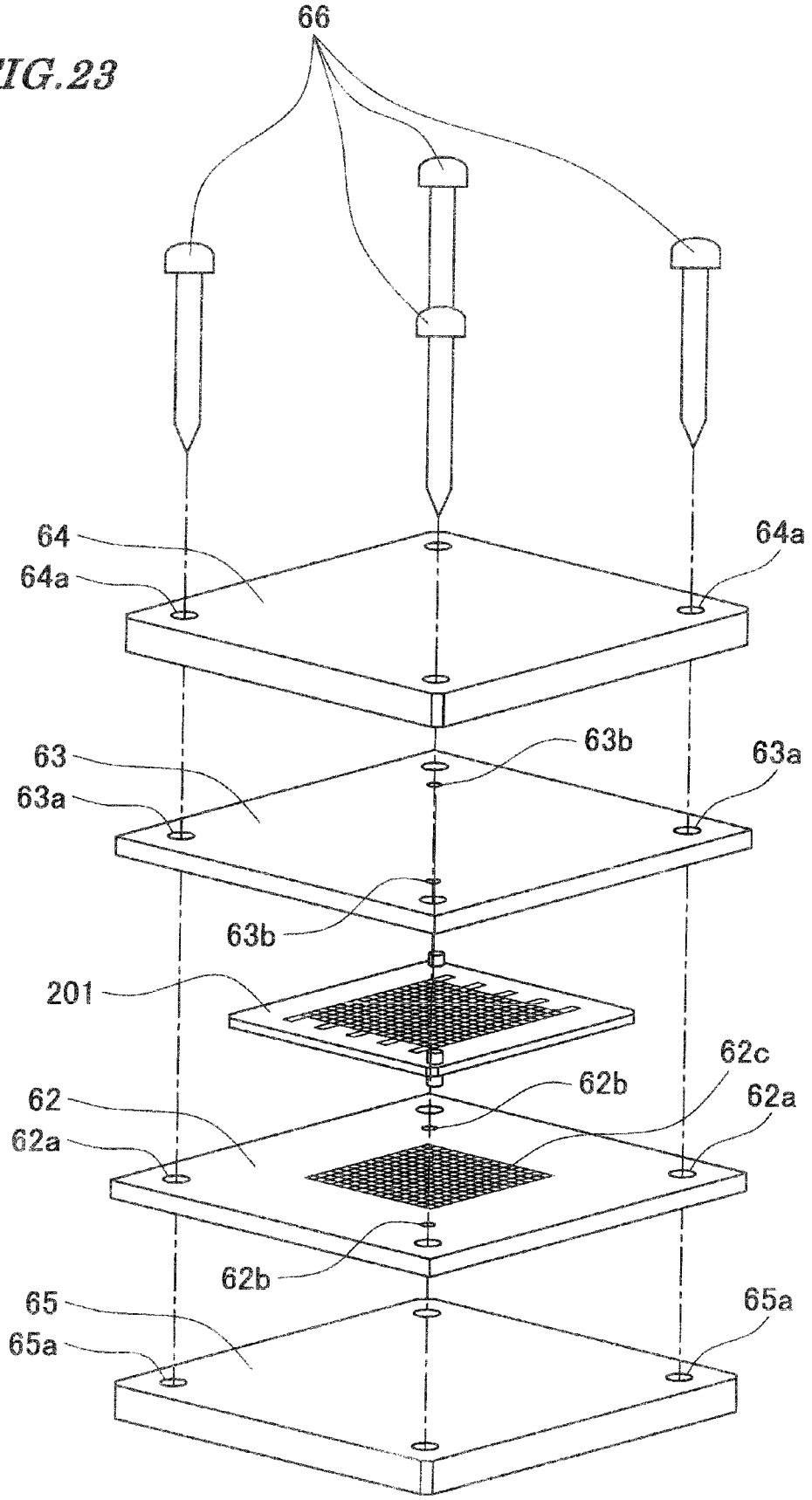
FIG. 23 is a perspective view of a printed board, a printed board, and the connector shown in FIG. 22, in a state before the printed board and the printed board are electrically connected by the connector.

As shown in FIG. 23, the connector 201 connects between a printed board (first object to be connected) 63 and the printed board 62. As shown in FIG. 22, a frame portion 221 of a frame 202 of the connector 201 is formed only by a component corresponding to the frame main body 211 of the connector 1 according to the first embodiment. The frame portion 221 has positioning pins 221*a* provided on each of upper and lower surfaces thereof. When the printed board 63 and the printed board 62 are connected by the connector 201, as shown in FIG. 23, the printed board 62, the connector 201, the printed board 63, and the upper stiffener 64 are sequentially arranged on the lower stiffener 65, one upon another. In doing this, the positioning pins 221*a* on the upper surface of the frame portion 221 are inserted into positioning holes 63*b* of the printed board 63, and the positioning pins 221*a* on the lower surface of the frame portion 221 are inserted into positioning holes 62*b* of the printed board 62, respectively. Then, the screws 66 are inserted through the holes 64*a* of the upper stiffener 64 and holes 63*a* of the printed board 63, and ends of the screws 66 are screwed into the screw holes 65*a* of the lower stiffener 65.

According to the second embodiment, it is possible to obtain the same advantageous effects as provided by the first embodiment.

Next, a description will be given of a connector 301 according to a third embodiment of the present invention, with reference to FIGS. 24 to 32. Although FIG. 25 is a partial enlarged view of the connector 301 shown in FIG. 24, the connector 301 is illustrated in a state in which some of contact members 303 are removed, for convenience of explanation.

Components identical to those in the above-described first embodiment are denoted by the same reference numerals, and description thereof is omitted. Hereafter, only main differences from the first embodiment will be described.

Figure 24:
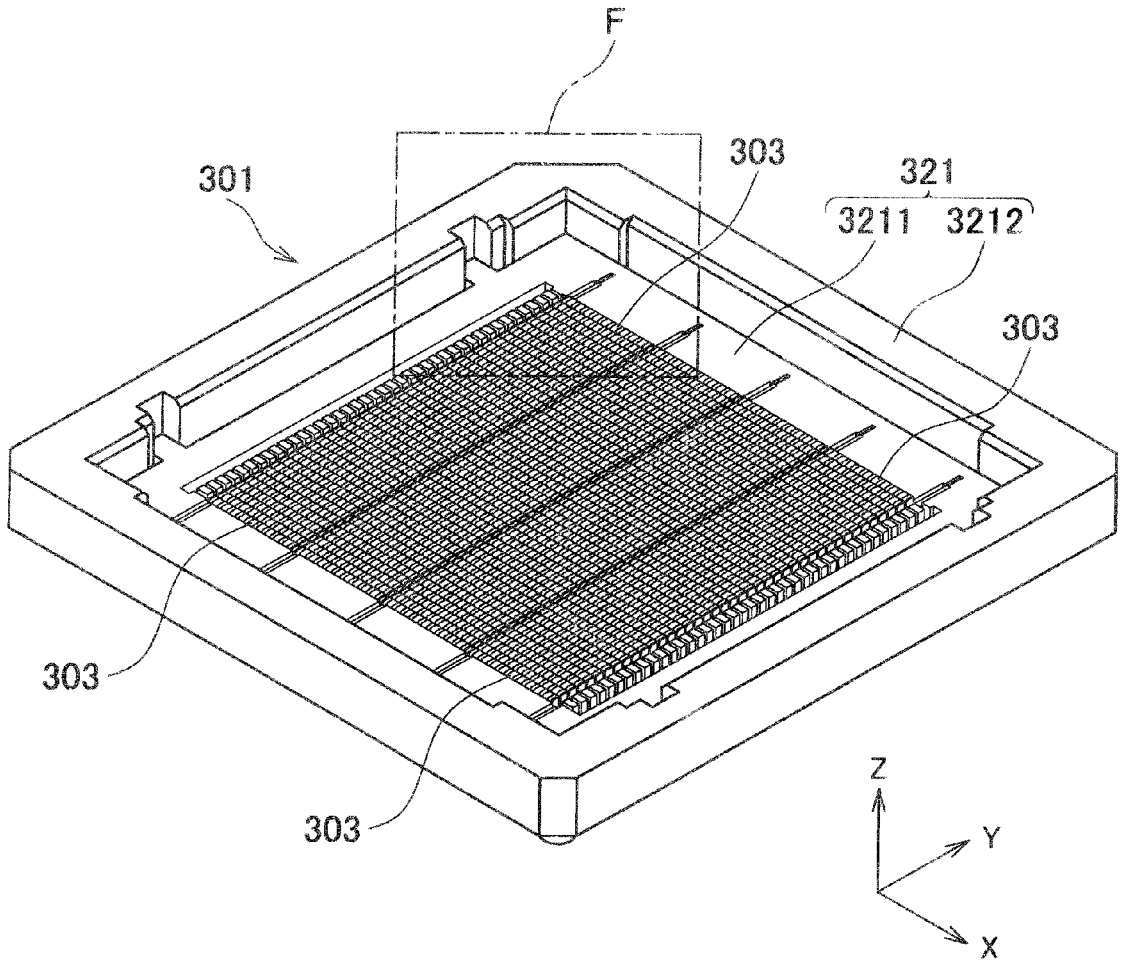
FIG. 24 is a perspective view of a connector according to a third embodiment of the present invention.
Figure 25:
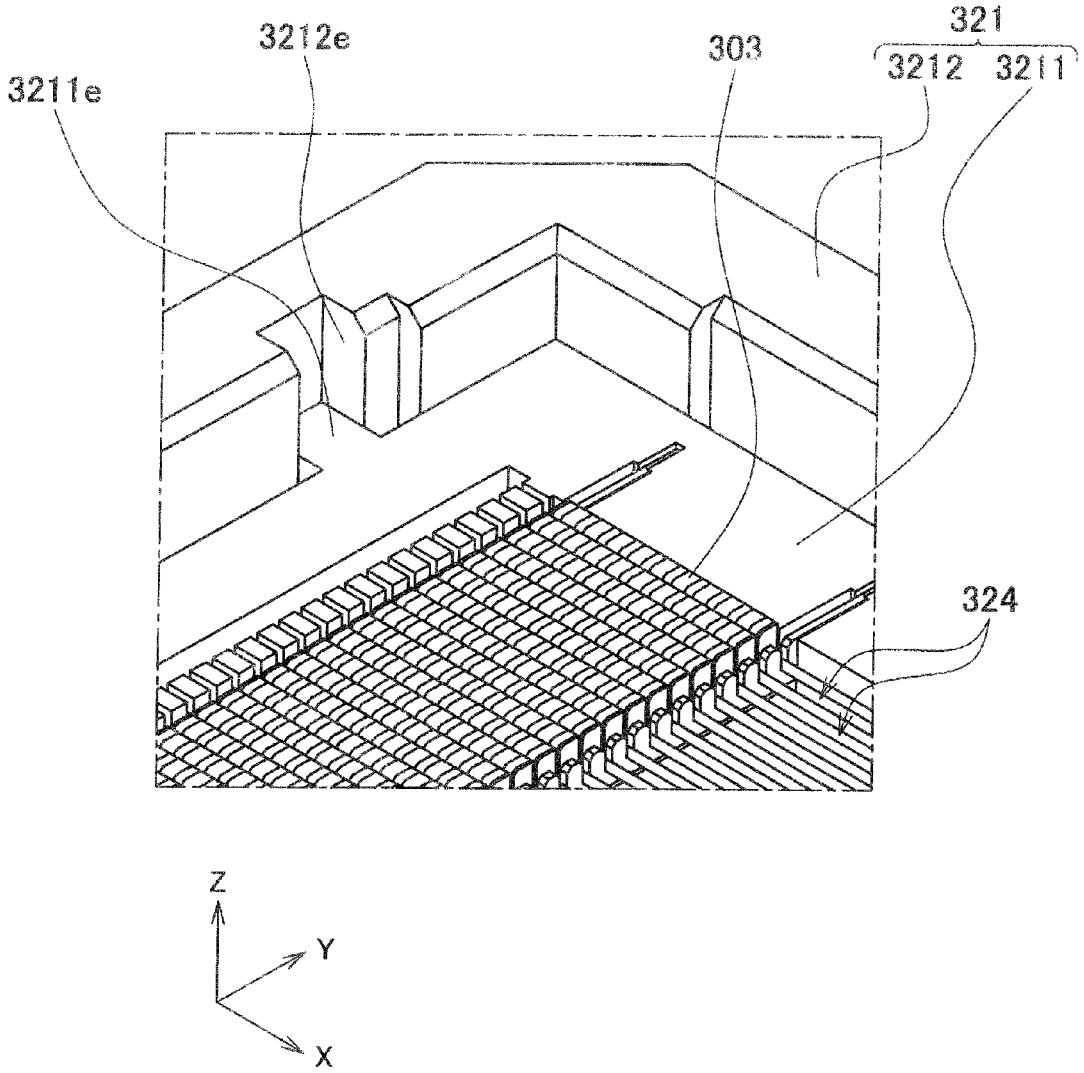
FIG. 25 is an enlarged view of a portion F in FIG. 24 (but with partial omission of the contact members)
Figure 26:
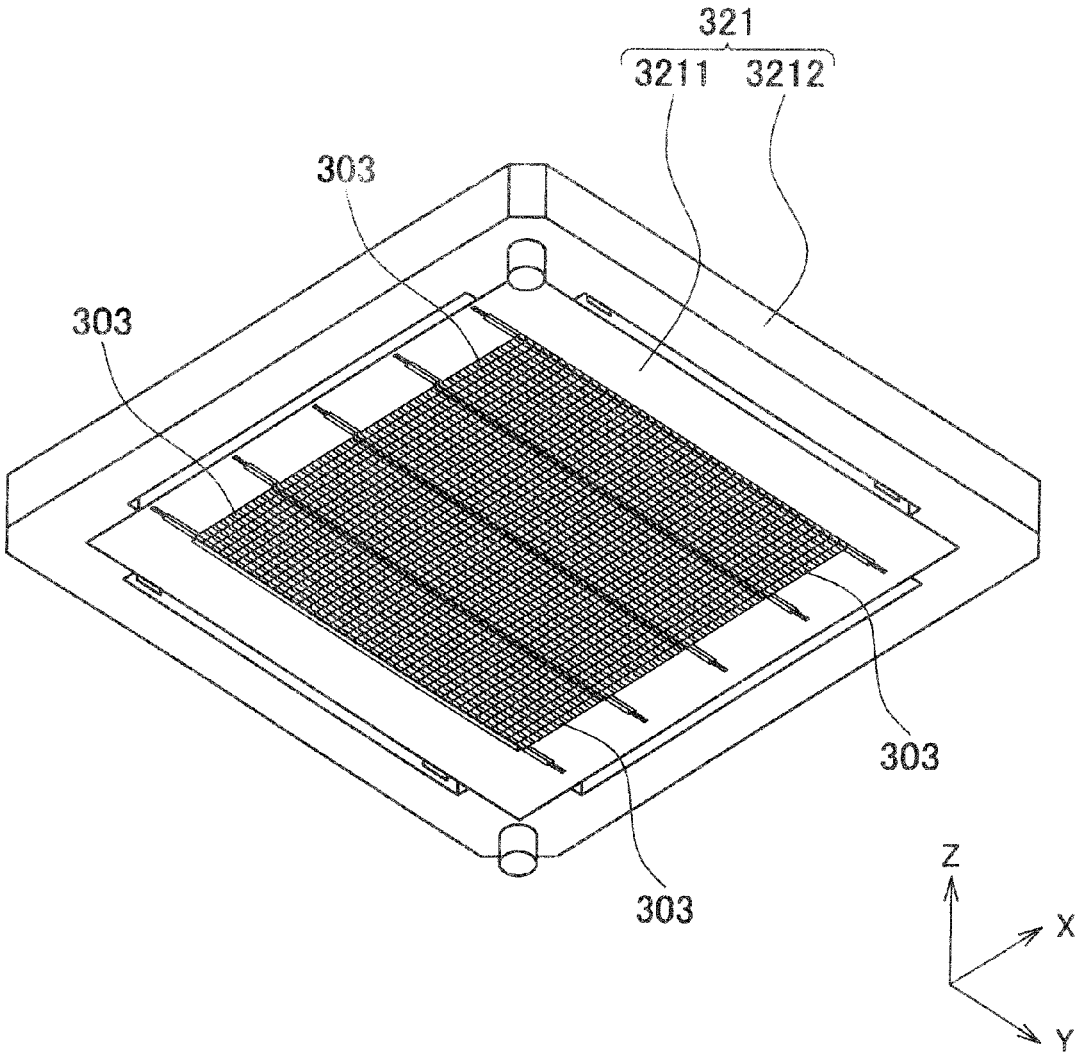
FIG. 26 is a perspective view of the connector shown in FIG. 24, as viewed obliquely from below.
Figure 27:
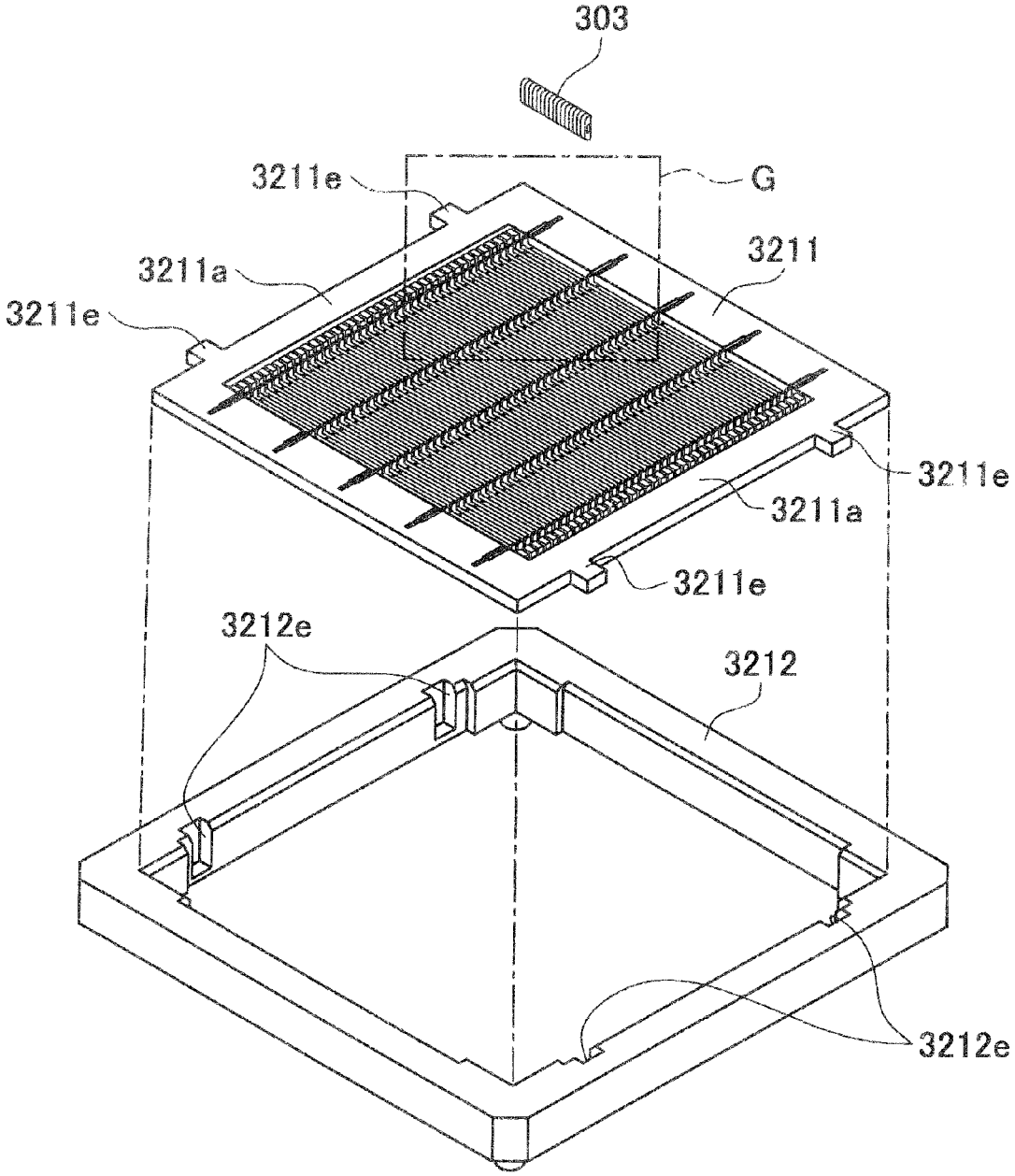
FIG. 27 is an exploded perspective view of the connector shown in FIG. 24.
Figure 28:
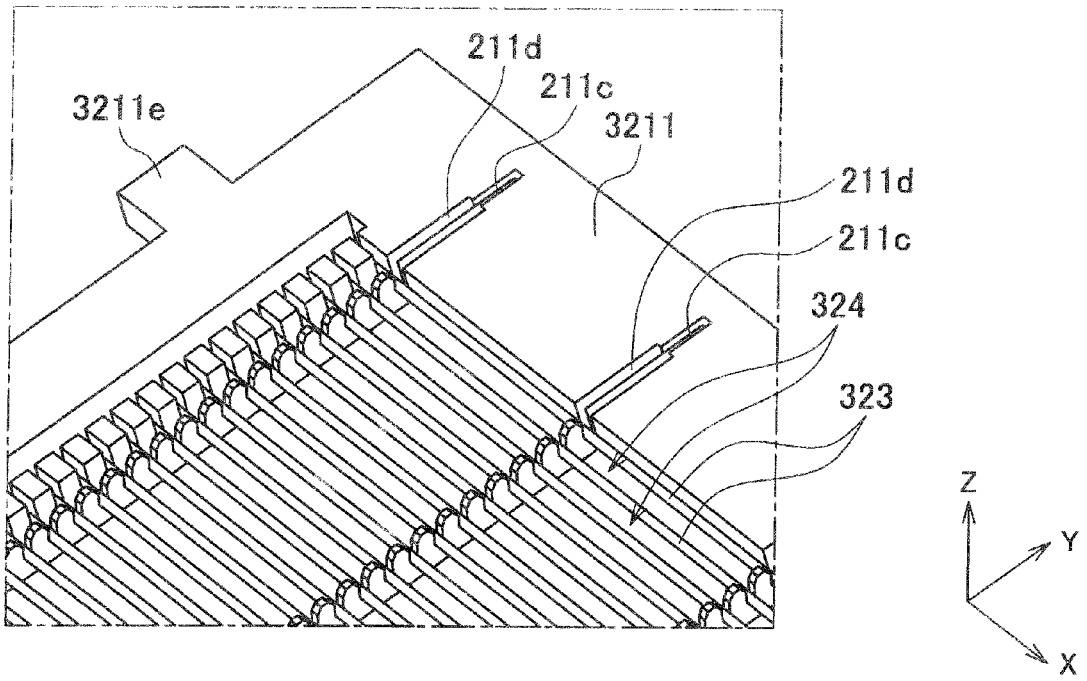
FIG. 28 is an enlarged view of a portion G in FIG. 27.
Figure 29:
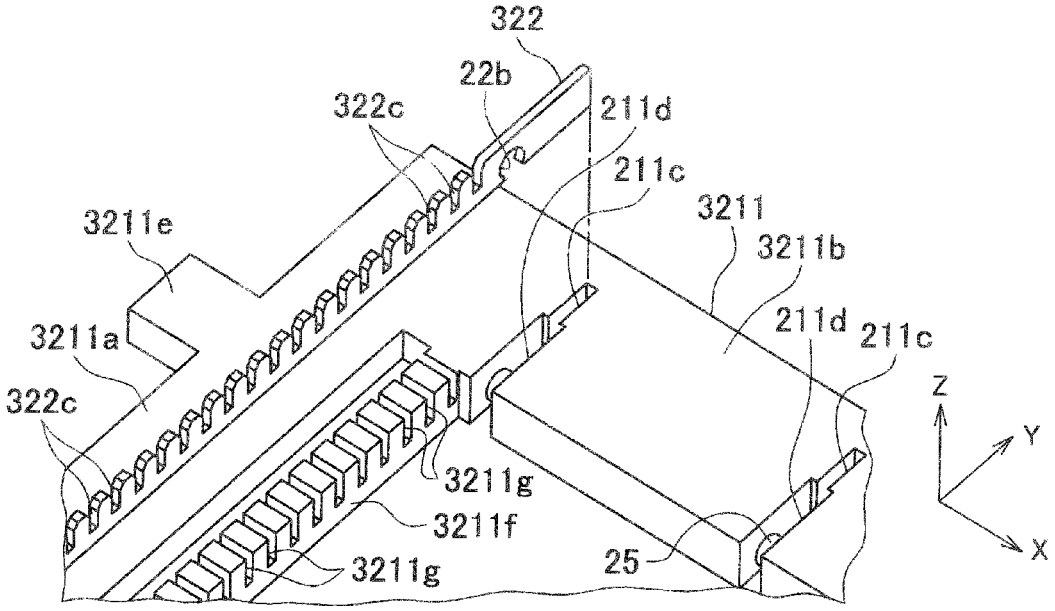
FIG. 29 is a partial enlarged perspective view of a frame portion in a state before a longitudinal rib is assembled thereto.

As shown in FIGS. 24, 25, and 26, a frame portion 321 of the connector 301 according to the third embodiment is composed of a frame main body 3211 and an outer frame 3212. As shown in FIGS. 27, 28, and 29, a pair of longitudinal boards 3211*a* of the frame main body 3211 are each formed with two protrusions 3211*e*. The frame main body 3211 is provided with a pair of wire holding portions 3211*f* each having a bar-like shape. The pair of wire holding portions 3211*f* each extend between a pair of horizontal boards 3211*b* of the frame main body 3211 (see FIG. 29) in a bridging manner. The pair of wire holding portions 3211*f* are at respective locations close to the pair of longitudinal boards 3211*a*. Each wire holding portion 3211*f* has recesses 3211*g* formed in an upper part thereof at equally-spaced intervals.

As shown in FIG. 27, the outer frame 3212 has two recesses 3212*e* formed in each of inner wall surfaces opposed to each other. The recesses 3212*e* receive and hold the protrusions 3211*e* of the frame main body 3211, respectively.

As shown in FIG. 29, each longitudinal rib (longitudinal member) 322 has a plurality of grooves 322*c* formed therein at equally-spaced intervals.

Figure 30:
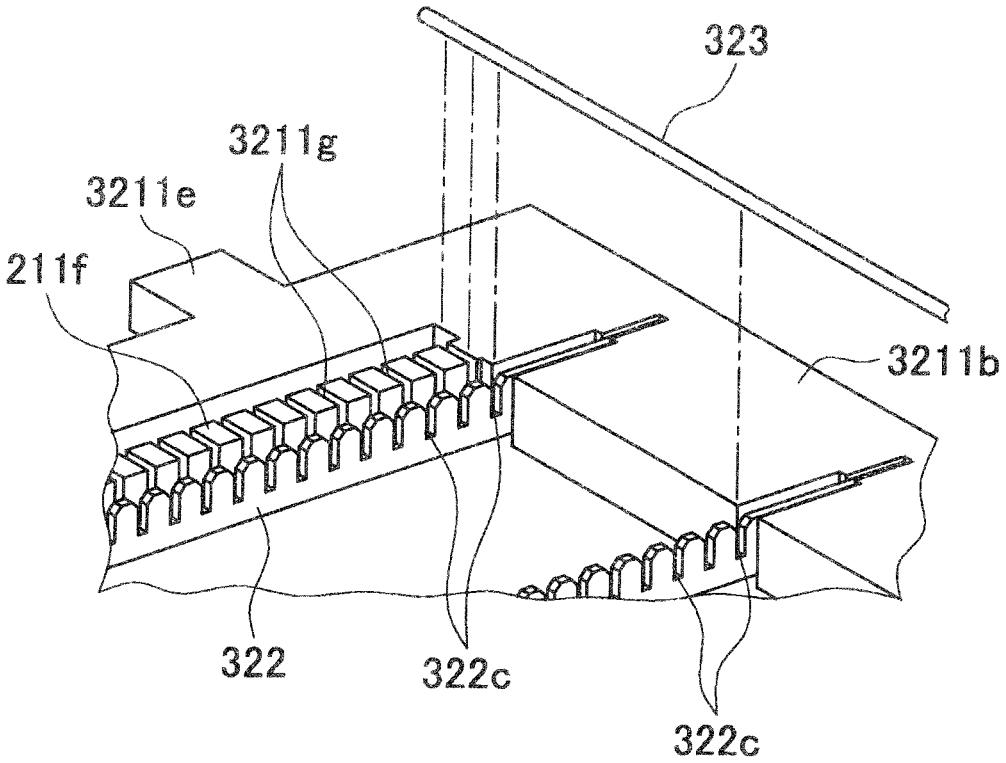
FIG. 30 is a partial enlarged perspective view of the frame portion in a state before a wire is assembled thereto.
Figure 31:
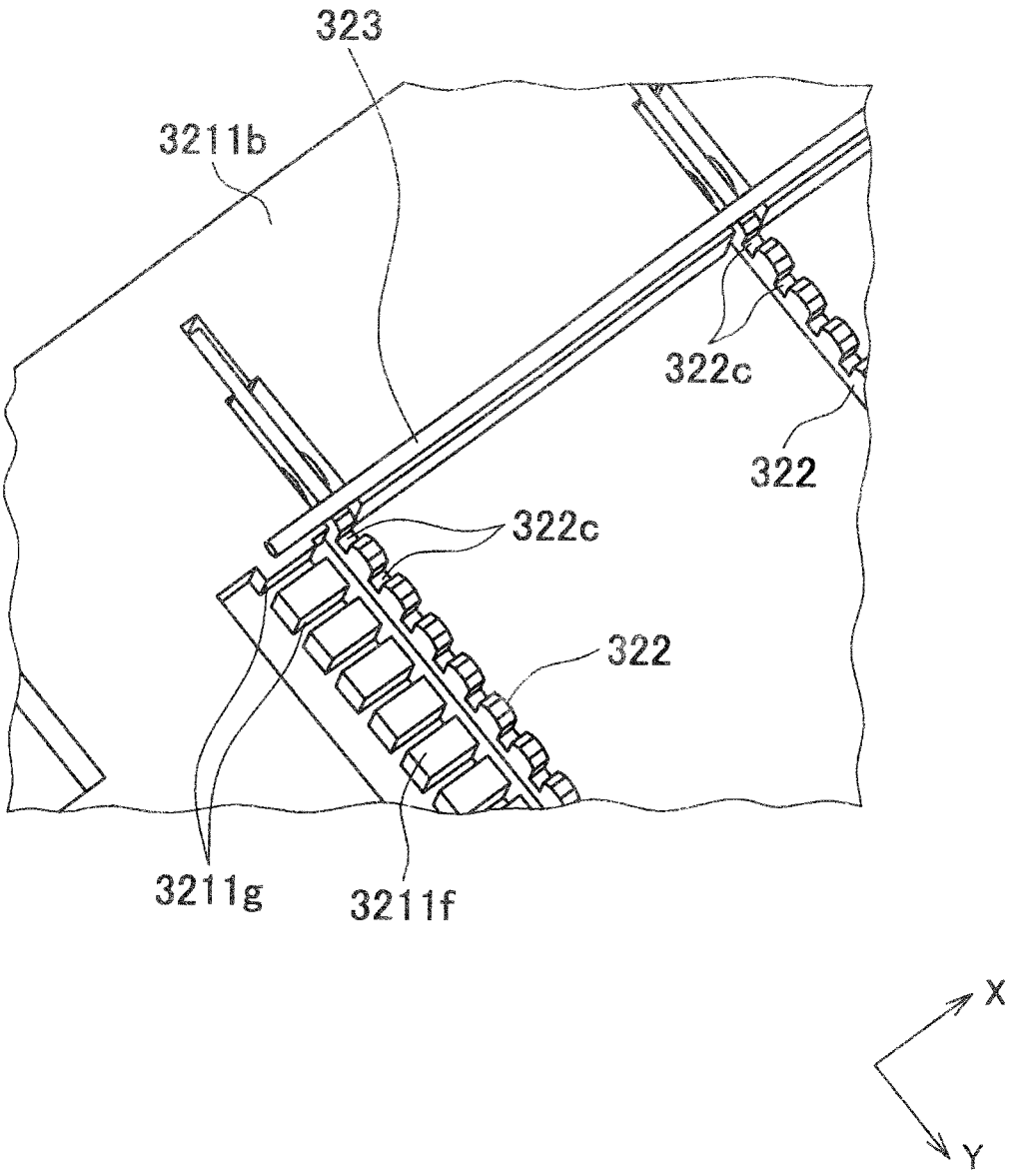
FIG. 31 is a view of the frame portion shown in FIG. 30, as viewed from another angle.

As shown in FIGS. 30 and 31, in the third embodiment, wires 323 are employed as the transverse members of the frame 302. The wires 323 are pressed into the recesses 3211*g* of the wire holding portions 3211*f* and the grooves 322*c* of the longitudinal ribs 322 in a tensioned state. As a result, the slits 324 are formed by the longitudinal ribs 322 and the wires 323, as shown in FIG. 28.

Figure 32:
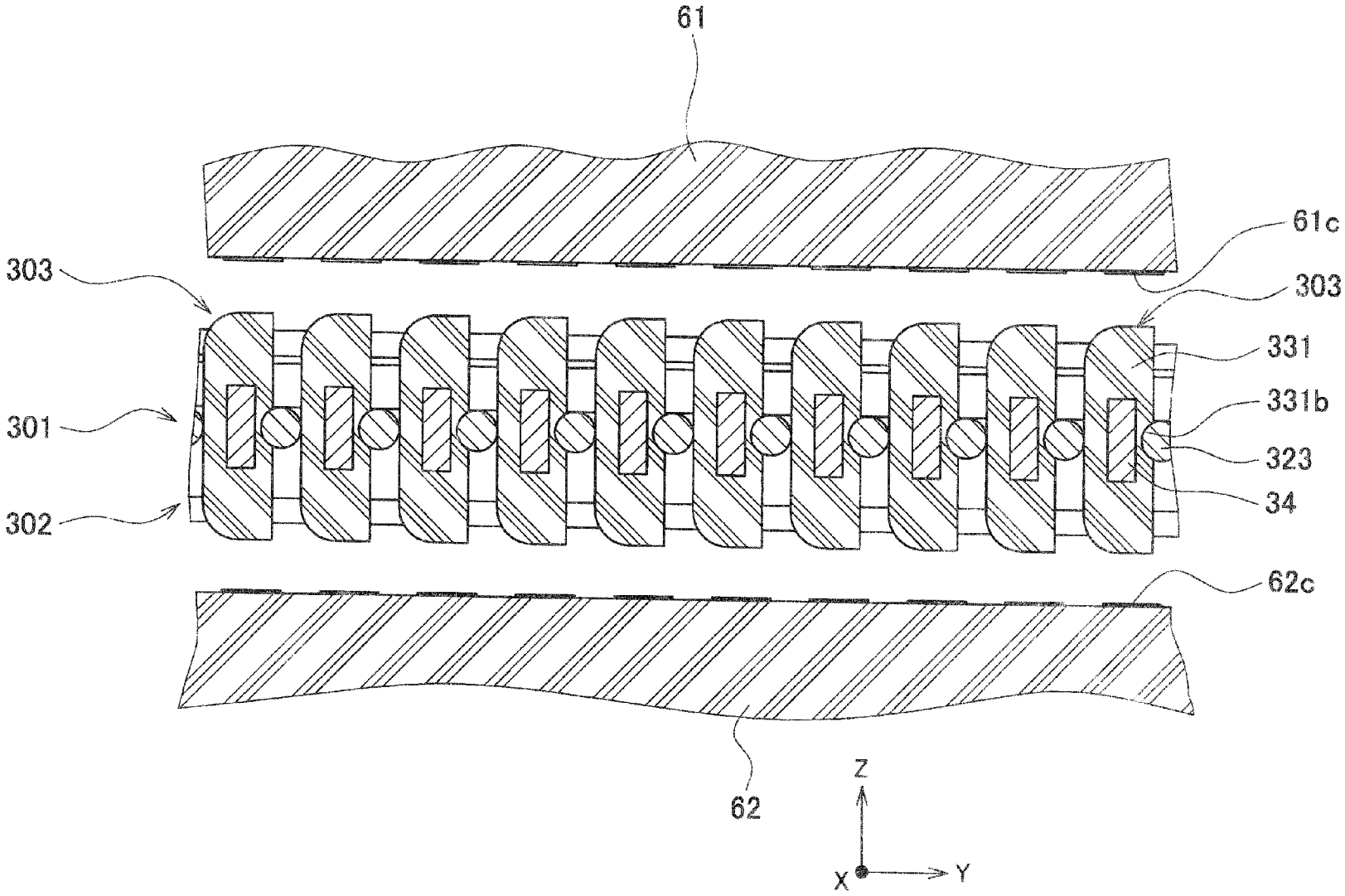
FIG. 32 is a partial enlarged cross-sectional view of an IC package, a printed board, and the connector shown in FIG. 24, in a state before the IC package and the printed board are electrically connected by the connector.

As shown in FIG. 32, an insulating elastic member 331 of each contact member 303 has a recess 331*b* formed in a rear surface thereof. The recess 331*b* extends along a direction of the length of the contact member 303. Each wire 323 is partially fitted in the recess 331*b*. This prevents the contact member 303 from being easily removed from the associated slit 324.

According to the third embodiment, it is possible to obtain the same advantageous effects as provided by the first embodiment.

Next, a description will be given of a connector 401 according to a fourth embodiment of the present invention with reference to FIGS. 33 to 38.

Components identical to those in the above-described first and third embodiments are denoted by the same reference numerals, and description thereof is omitted. Hereafter, only main differences from the first and third embodiments will be described. Although FIG. 34 is a partial enlarged view of the connector 401 shown in FIG. 33, the connector 401 is illustrated in a state in which some of contact members 403 are removed, for convenience of explanation.

Figure 33:
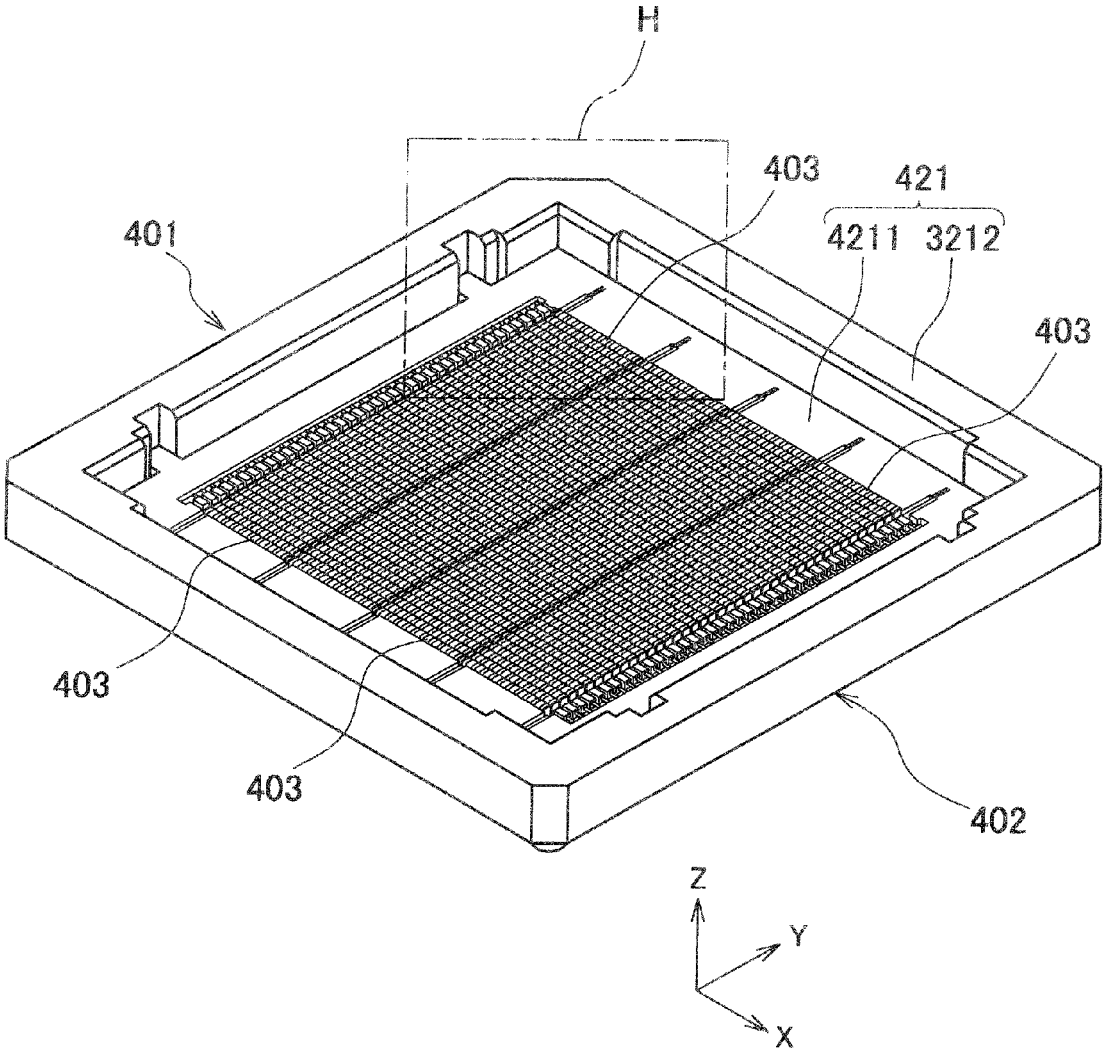
FIG. 33 is a perspective view of a connector according to a fourth embodiment of the present invention.
Figure 34:
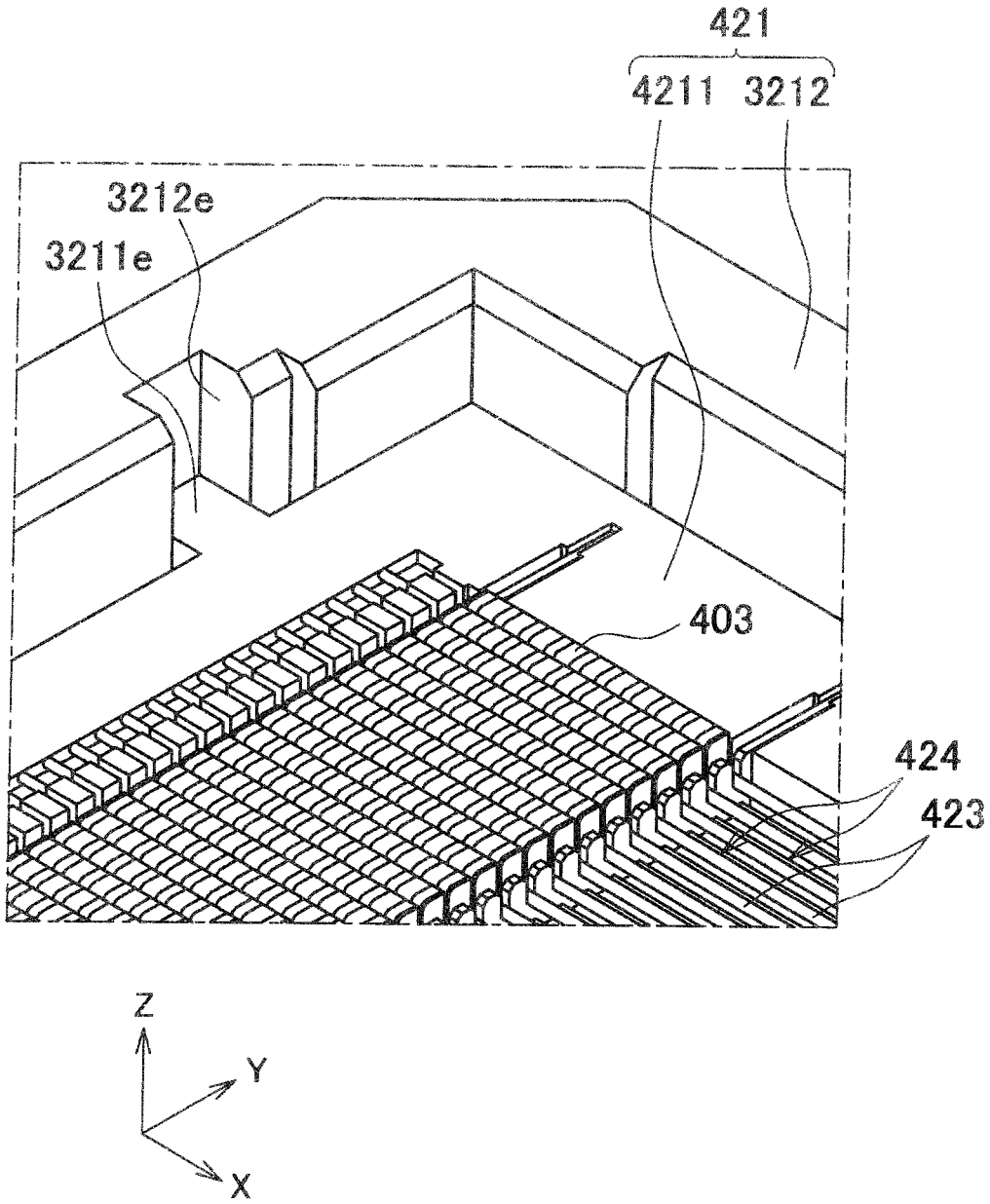
FIG. 34 is an enlarged view of a portion H in FIG. 33 (but with partial omission of contact members)
Figure 35:
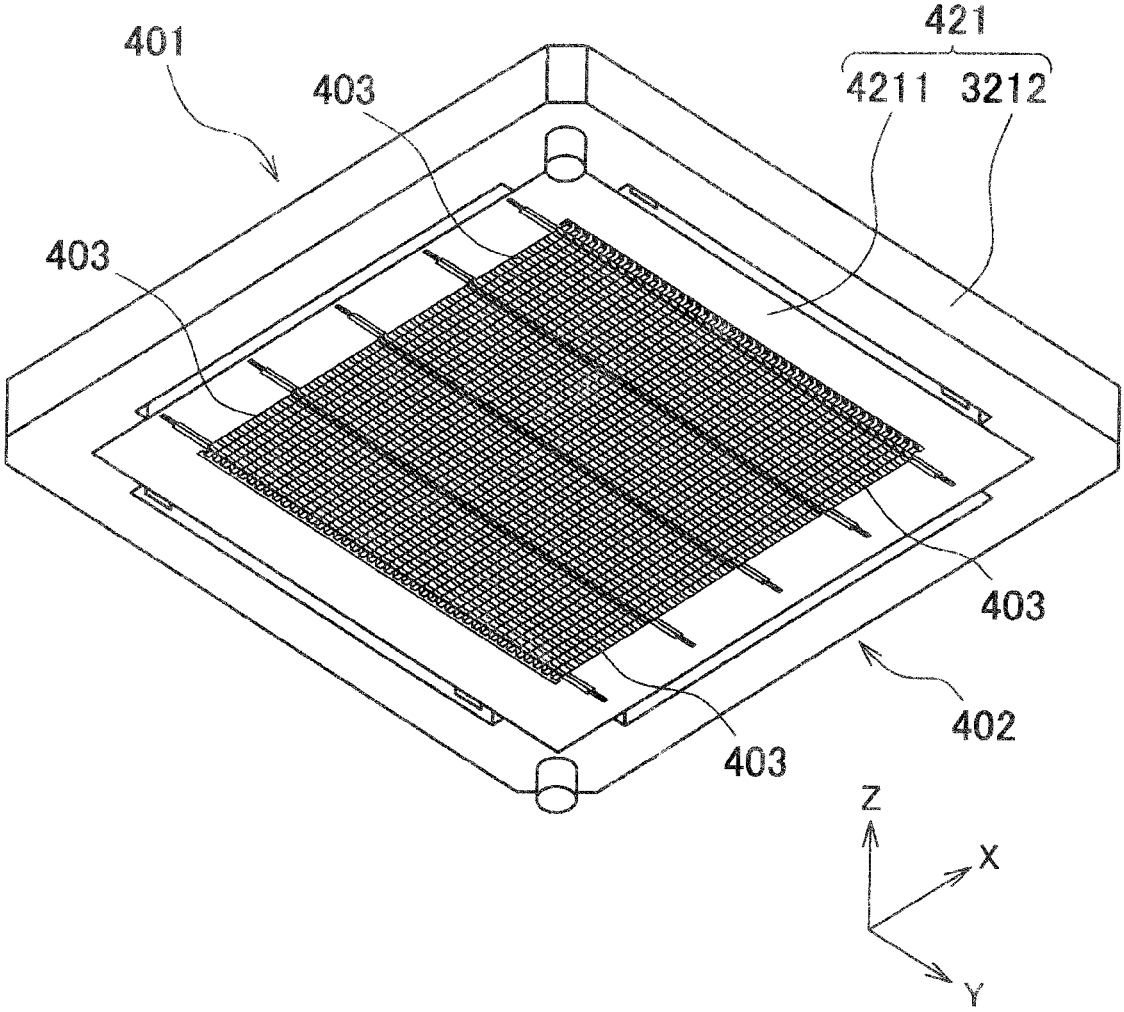
FIG. 35 is a perspective view of the connector shown in FIG. 33, as viewed obliquely from below.

As shown in FIGS. 33, 34, and 35, although the connector 301 according to the third embodiment employs one wire 323 as one transverse member of the frame 302, the connector 401 according to the fourth embodiment employs a pair of wires 423 as one transverse member of a frame 402.

Figure 36:
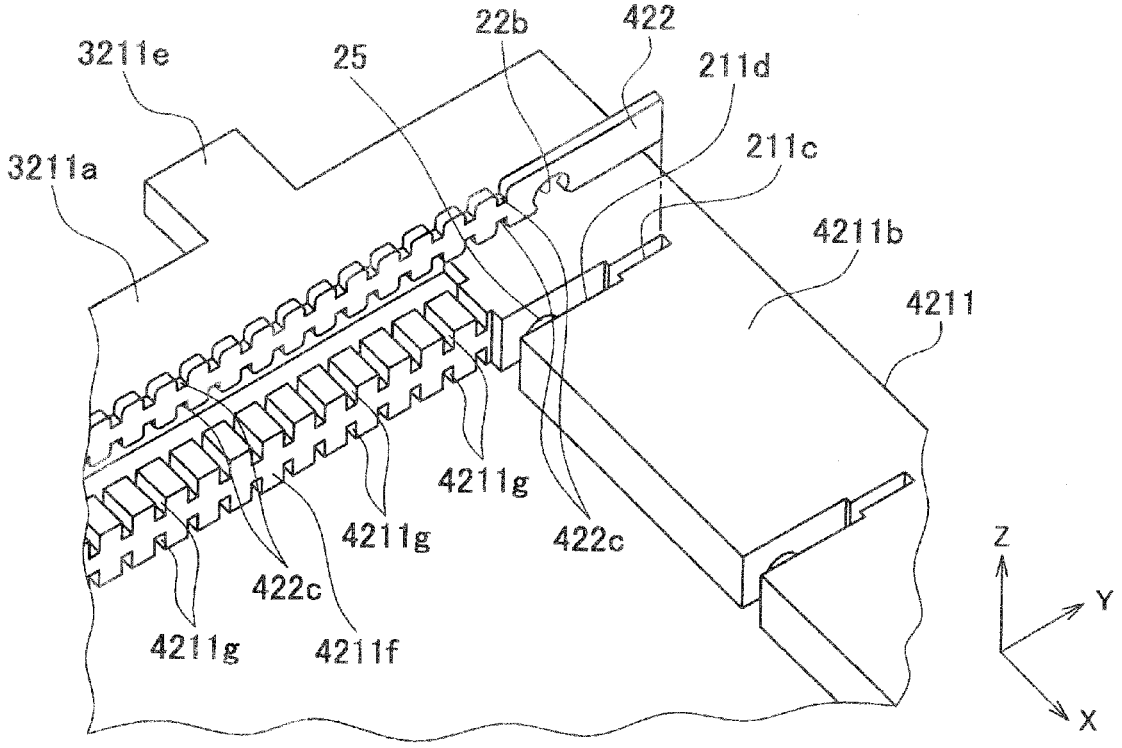
FIG. 36 is a partial enlarged perspective view of a frame portion in a state before longitudinal ribs are assembled thereto.
Figure 37:
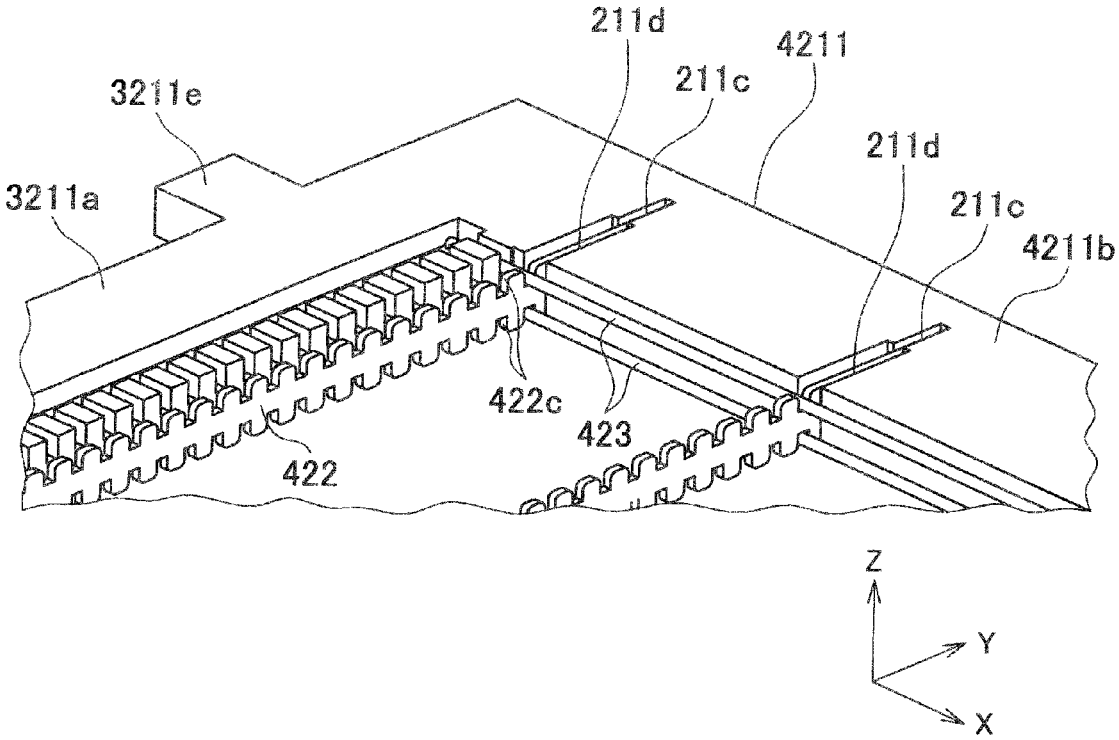
FIG. 37 is a partial enlarged perspective view of the frame portion in a state having the longitudinal ribs assembled thereto.

For this reason, as shown in FIGS. 36 and 37, wire holding portions 4211*f* extending in a bridging manner between a pair of horizontal boards 4211*b* of a frame main body 4211 of a frame portion 421 each have recesses 4211*g* formed in each of an upper part and a lower part thereof at equally-spaced intervals. Similarly, each longitudinal rib (longitudinal member) 422 has grooves 422*c* formed in each of an upper part and a lower part thereof at equally-spaced intervals.

Figure 38:
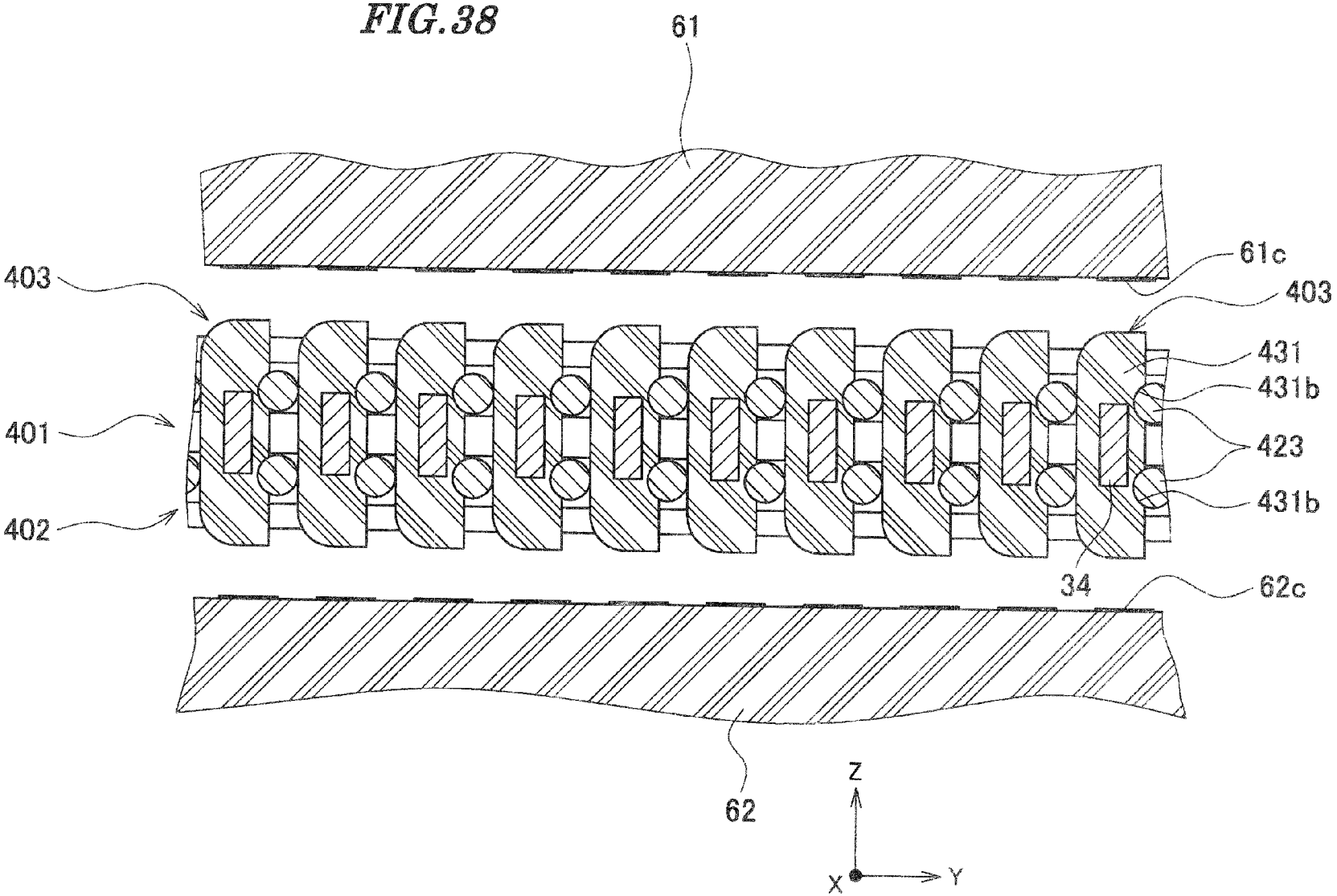
FIG. 38 is a partial enlarged cross-sectional view of an IC package, a printed board, and the connector shown in FIG. 33, in a state before the IC package and the printed board are connected by the connector.

Further, as shown in FIG. 38, an insulating elastic member 431 of each contact member 403 has two recesses 431*b* formed in a rear surface thereof. The pair of wires 423 are partially fitted in the two recesses 431*b*, respectively. This prevents each contact member 403 from being easily removed from an associated one of slits 424.

According to the fourth embodiment, it is possible to obtain the same advantageous effects as provided by the first and third embodiments.

Next, a description will be given of a connector 501 according to a fifth embodiment of the present invention with reference to FIG. 39.

Components identical to those in the above-described first and fourth embodiments are denoted by the same reference numerals, and description thereof is omitted. Hereafter, only main differences from the first and fourth embodiments will be described.

Figure 39:
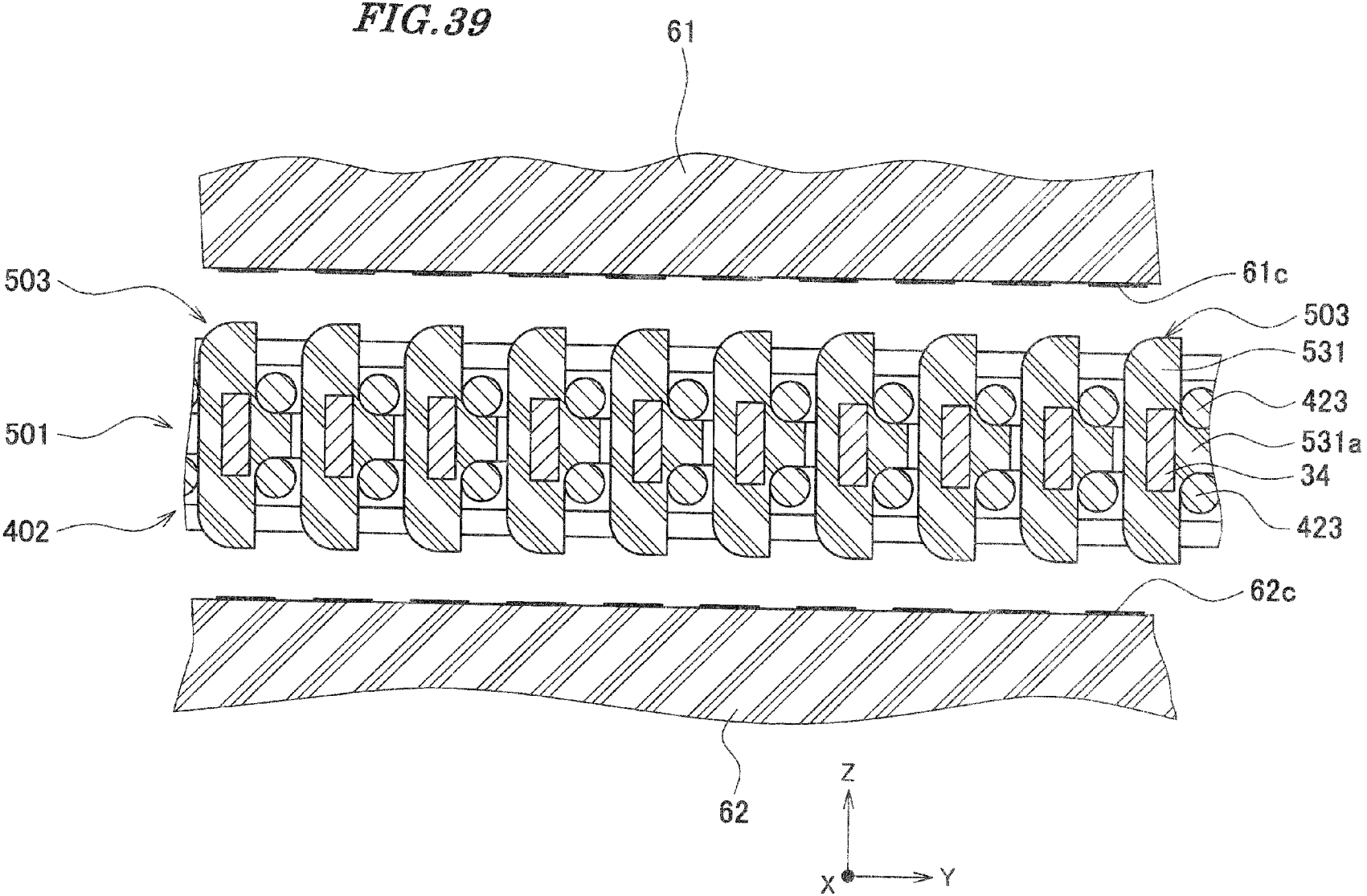
FIG. 39 is a cross-sectional view of an IC package, a printed board, and a connector according to a fifth embodiment of the present invention, in a state before the IC package and the printed board are connected by the connector.
Figure 40:
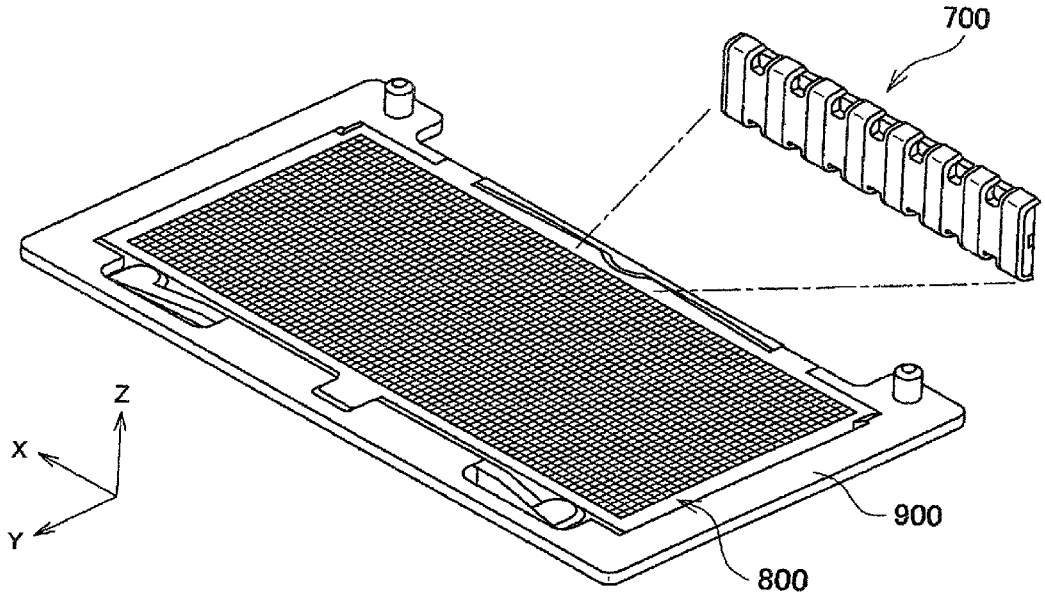
FIG. 40 PRIOR ART
FIG. 40 is a perspective view of a conventional connector.
Figure 41:
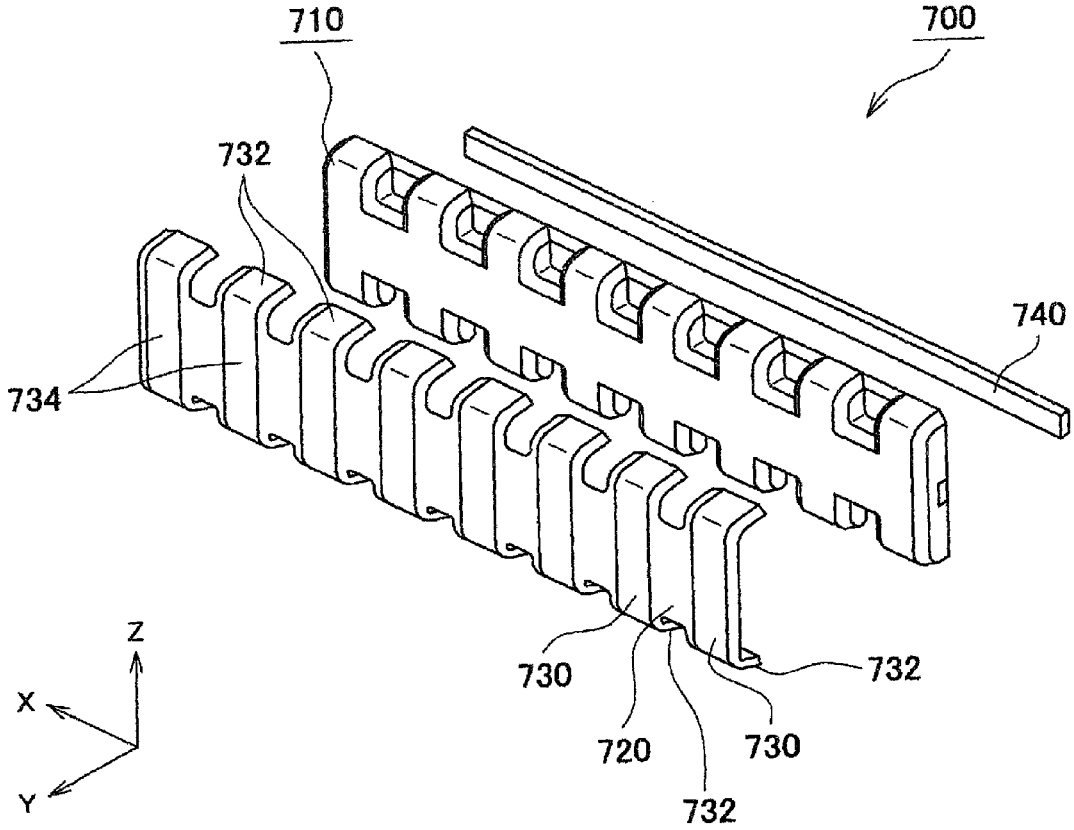
FIG. 41 PRIOR ART
FIG. 41 is an exploded perspective view of a conductive elastic member appearing in FIG. 40.
Figure 42:
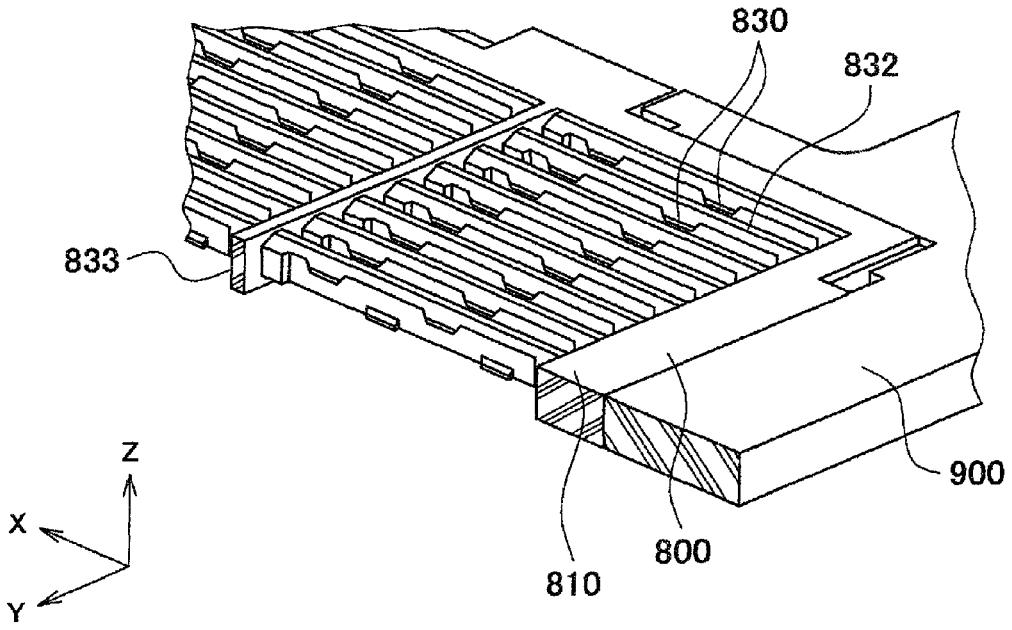
FIG. 42 PRIOR ART
FIG. 42 is an enlarged perspective view of an inner frame and an outer frame appearing in FIG. 40.
Figure 43:
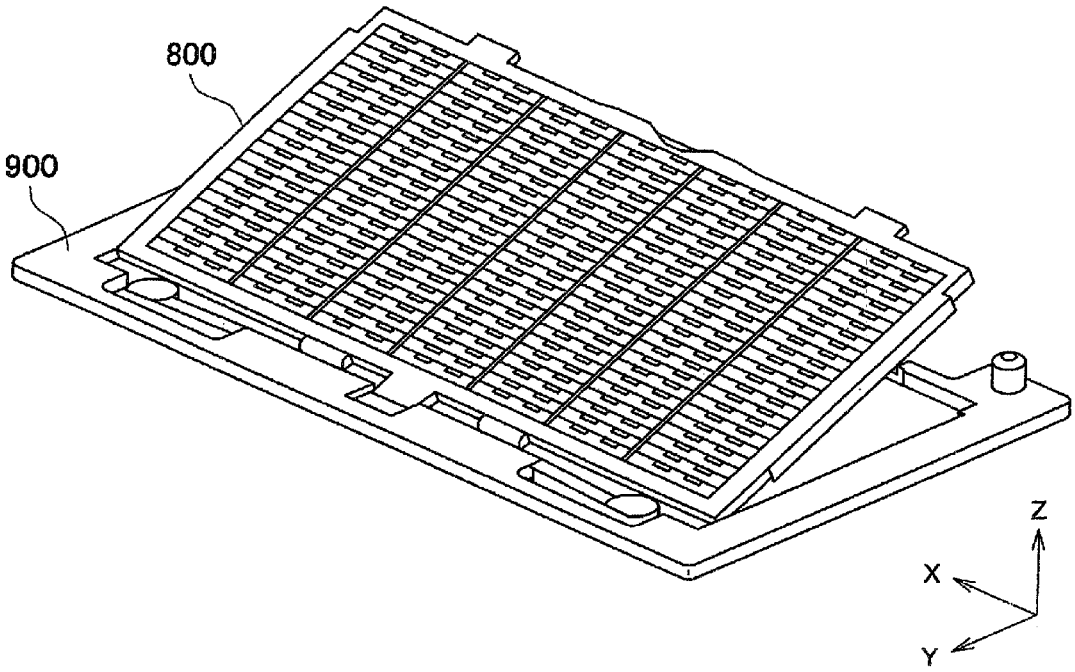
FIG. 43 PRIOR ART
FIG. 43 is a view useful in explaining a process for assembling the inner frame and the outer frame appearing in FIG. 40.

As shown in FIG. 39, although in the connector 401 according to the fourth embodiment, the pair of wires 423 are fitted in the recesses 431*b* of the insulating elastic member 431 of each contact member 403, respectively, in the connector 501 according to the fifth embodiment, the pair of wires 423 sandwiches a protrusion 531*a* formed on a rear surface of an insulating elastic member 531 of each contact member 503, whereby each contact member 503 is held.

According to the fifth embodiment, it is possible to obtain the same advantageous effects as provided by the first and fourth embodiments.

Although in the first and second embodiments, the longitudinal ribs 22 and the transverse ribs 23 are connected at intersecting portions thereof in a separable manner, it is not necessary to make the longitudinal ribs 22 and the transverse ribs 23 separable at the intersecting portions thereof. Similarly, although in the third to fifth embodiments, the longitudinal ribs 322 or 422 and the wires 323 or 423 are connected at intersecting portions thereof, it is not necessary to connect the longitudinal ribs 322 or 422 and the wires 323 or 423 at the intersecting portions thereof.

Further, although in the first and second embodiments, the protrusions 31*a* of each contact member 3 are inserted in the holes 23*c* of the associated transverse rib 23, each contact member 3 may be formed with holes or recesses, not shown, and protrusions (not shown) formed on the associated transverse rib 23 may be inserted in the holes or recesses.

Although in the above-described embodiments, the direction along the length of the contact members 3, 103, 203, 303, 403, or 503 is parallel to the direction along the length of the transverse ribs 23, or the wires 323 or 423, the transverse members (the transverse ribs 23, and the wires 323 and 423) and the longitudinal members (the longitudinal ribs 22, 322, and 422) may be assembled such that the direction along the length of the contact members 3, 103, 203, 303, 403, or 503 is parallel to the direction along the length of the longitudinal ribs 22, 322, or 422. In this case, protrusions (or recesses) formed on (in) the contact members 3, 103, 203, 303, 403, or 503 are fitted in holes (or on protrusions) formed in (on) the longitudinal ribs 22, 322, or 422, respectively.

Note that the longitudinal ribs 22, 322, or 422 are not necessarily required to be arranged on the frame portion 21, 221, 321, or 421 at equally-spaced intervals.

Further, the frame portion 221, the frame main bodies 211, 3211, and 4211, and the outer frame 212 and 3212 may be formed of a conductive material, such as a metal.

Although in the above-described embodiments, each of the longitudinal members (the longitudinal ribs 22, 322, and 422) and the transverse members (the transverse ribs 23, and the wires 323 and 423) is configured to have insulation properties, only transverse members may be configured to have insulation properties.

It is further understood by those skilled in the art that the foregoing are the preferred embodiments of the present invention, and that various changes and modification may be made thereto without departing from the spirit and scope thereof.

What is claimed is:

1. A connector that electrically connects between a first object to be connected and a second object to be connected, comprising:

a frame that includes:

a frame portion, a plurality of longitudinal members each extending in a manner bridging said frame portion, each of said plurality of longitudinal members being separate from said frame portion; and a plurality of transverse members each extending orthogonal to said plurality of longitudinal members in a manner bridging said frame portion, each of said plurality of transverse members being separate from said frame portion and being separate from said longitudinal members; and a plurality of contact members that are elastically deformed by being sandwiched between the first object to be connected and the second object to be connected, wherein said transverse members have insulation properties and said longitudinal members do not have insulation properties, or said transverse members and said longitudinal members both have insulation properties, and wherein each contact member includes a plurality of conductive path portions for electrically connecting first terminal portions formed on the first object to be connected and second terminal portions formed on the second object to be connected, respectively, and each contact member is held in a respective one of a plurality of slits formed by said longitudinal members and said transverse members.

2. The connector as claimed in claim 1, wherein each of said longitudinal members and each of said transverse members comprises a plate-shaped rib, and wherein said longitudinal members and said transverse members are connected at intersecting portions thereof.

3. The connector as claimed in claim 2, wherein each contact member has protrusions, and wherein said protrusions are inserted in holes formed in an associated one of said longitudinal members and said transverse members.

4. The connector as claimed in claim 2, wherein said frame portion includes:

positioning grooves that receive opposite ends of said longitudinal members, and position said longitudinal members with respect to said frame portion;

longitudinal member-fitting shafts that are at respective locations closer to central portions of said longitudinal members than the positioning grooves, and catch thereon longitudinal member cutouts formed in said opposite ends of said longitudinal members; and transverse member-fitting shafts that catch thereon transverse member cutouts formed in opposite ends of said transverse members.

5. The connector as claimed in claim 3, wherein said frame portion includes:

positioning grooves that receive opposite ends of said longitudinal members, and position said longitudinal members with respect to said frame portion;

longitudinal member-fitting shafts that are at respective locations closer to central portions of said longitudinal members than the positioning grooves, and catch thereon longitudinal member cutouts formed in said opposite ends of said longitudinal members; and transverse member-fitting shafts that catch thereon transverse member cutouts formed in opposite ends of said transverse members.

6. The connector as claimed in claim 1, wherein each longitudinal member comprises a plate-shaped rib and each transverse member comprises a wire, or each longitudinal member comprises a wire and each transverse member comprises a plate-shaped rib, and wherein said longitudinal members and said transverse members are connected at intersecting portions thereof.

7. The connector as claimed in claim 6, wherein a recess formed in each contact member is caught on a corresponding one of the transverse members.

8. The connector as claimed in claim 1, wherein each longitudinal member comprises a plate-shaped rib and each transverse member comprises a pair of wires parallel to each other, or each longitudinal member comprises a pair of wires parallel to each other and each transverse member comprises a plate-shaped rib, and wherein said longitudinal members and said transverse members are connected at intersecting portions thereof.

9. The connector as claimed in claim 8, wherein each contact member has recesses formed therein which correspond to said pair of wires, and wherein the recesses are caught on said pair of wires.

10. The connector as claimed in claim 8, wherein each contact member includes a protrusion, and wherein said protrusion is sandwiched between said pair of wires.

* * * * *